US007524403B2

(12) United States Patent
Fernandes et al.

(10) Patent No.: US 7,524,403 B2
(45) Date of Patent: Apr. 28, 2009

(54) FORMING FABRIC AND/OR TISSUE MOLDING BELT AND/OR MOLDING BELT FOR USE ON AN ATMOS SYSTEM

(75) Inventors: Ademar Lippi Alves Fernandes, Brummen (NL); Martin Ringer, Bury (GB); Carl Warren, Rosendale (GB)

(73) Assignee: Voith Paper Patent GmbH, Heidenheim (DE)

( * ) Notice: Subject to any disclaimer, the term of this patent is extended or adjusted under 35 U.S.C. 154(b) by 371 days.

(21) Appl. No.: 11/380,826

(22) Filed: Apr. 28, 2006

(65) Prior Publication Data

US 2007/0251659 A1 Nov. 1, 2007

(51) Int. Cl.

| | |
|---|---|
| ***D21F 3/02*** | (2006.01) |
| ***D21F 1/10*** | (2006.01) |
| ***B30B 5/04*** | (2006.01) |
| ***F26B 13/00*** | (2006.01) |

(52) U.S. Cl. ..... 162/358.4; 162/205; 162/348; 162/358.1; 162/364; 162/903; 100/37; 100/153; 34/123

(58) Field of Classification Search ..... 162/358.1, 162/358.3, 358.5, 204–207, 116, 348, 901, 162/358.4, 900–903, 363, 364, 367, 368, 162/359.1; 100/37, 121, 151–154, 118; 34/95, 306, 452, 453, 397, 398

See application file for complete search history.

(56) References Cited

U.S. PATENT DOCUMENTS

| | | | | |
|---|---|---|---|---|
| 3,293,121 | A | | 12/1966 | Martin |
| 3,301,746 | A | | 1/1967 | Sanford et al. |
| 3,399,111 | A | * | 8/1968 | Beaumont et al. ..... 162/199 |
| 3,797,384 | A | | 3/1974 | Hoff |
| 3,798,121 | A | | 3/1974 | Busker et al. |
| 3,974,026 | A | | 8/1976 | Emson et al. |
| 3,994,771 | A | | 11/1976 | Morgan, Jr. et al. |
| 4,102,737 | A | | 7/1978 | Morton |
| 4,162,190 | A | | 7/1979 | Ashworth |
| 4,191,609 | A | | 3/1980 | Trokhan |
| 4,239,065 | A | | 12/1980 | Trokhan |

(Continued)

FOREIGN PATENT DOCUMENTS

| | | |
|---|---|---|
| DE | 37 28 124 | 3/1989 |

(Continued)

OTHER PUBLICATIONS

U.S. Appl. No. 11/276,789, filed Mar. 14, 2006 is discussed on paragraph [0128] of the instant application.

(Continued)

*Primary Examiner*—Eric Hug
(74) *Attorney, Agent, or Firm*—Greenblum & Bernstein, P.L.C.

(57) ABSTRACT

A forming fabric for an ATMOS system or a TAD machine. The forming fabric includes a permeability value of between approximately 100 cfm and approximately 1200 cfm, a paper surface contact area of between approximately 0.5% and approximately 90% when not under pressure and tension, and an open area of between approximately 1.0% and approximately 90%. A belt press for a paper machine can utilize the forming fabric. This Abstract is not intended to define the invention disclosed in the specification, nor intended to limit the scope of the invention in any way.

32 Claims, 24 Drawing Sheets

U.S. PATENT DOCUMENTS

| | | | | |
|---|---|---|---|---|
| 4,427,734 | A | 1/1984 | Johnson | |
| 4,431,045 | A | 2/1984 | Josefsson | |
| 4,440,597 | A | 4/1984 | Wells et al. | |
| 4,464,226 | A | 8/1984 | Karvinen | |
| 4,496,429 | A | 1/1985 | Salminen et al. | |
| 4,564,551 | A | 1/1986 | Best | |
| 4,948,467 | A | 8/1990 | Creagan | |
| 5,053,109 | A | 10/1991 | Penven | |
| 5,200,260 | A | 4/1993 | Hsu | |
| 5,437,107 | A | 8/1995 | Ensign et al. | |
| 5,507,915 | A * | 4/1996 | Durkin et al. | 162/117 |
| 5,510,001 | A | 4/1996 | Hermans et al. | |
| 5,510,002 | A | 4/1996 | Hermans et al. | |
| 5,598,643 | A | 2/1997 | Chuang et al. | |
| 5,699,626 | A | 12/1997 | Chuang et al. | |
| 5,701,682 | A | 12/1997 | Chuang et al. | |
| 5,819,811 | A | 10/1998 | Baker et al. | |
| 5,830,316 | A | 11/1998 | Ampulski | |
| 5,853,547 | A * | 12/1998 | Ahrens et al. | 162/348 |
| 5,865,955 | A | 2/1999 | Ilvespaa et al. | |
| 6,051,105 | A | 4/2000 | Ampulski | |
| 6,094,834 | A | 8/2000 | Taipale et al. | |
| 6,096,169 | A | 8/2000 | Hermans et al. | |
| 6,140,260 | A | 10/2000 | Johnson et al. | |
| 6,149,767 | A | 11/2000 | Hermans et al. | |
| 6,187,137 | B1 | 2/2001 | Druecke et al. | |
| 6,228,220 | B1 | 5/2001 | Hada et al. | |
| 6,237,644 | B1 | 5/2001 | Hay et al. | |
| 6,331,230 | B1 | 12/2001 | Hermans et al. | |
| 6,436,240 | B1 | 8/2002 | Jeffrey | |
| 6,454,904 | B1 | 9/2002 | Hermans et al. | |
| 6,497,789 | B1 | 12/2002 | Hermans et al. | |
| 6,514,382 | B1 | 2/2003 | Kakiuchi et al. | |
| 6,616,812 | B2 | 9/2003 | Beck | |
| 6,780,282 | B2 | 8/2004 | Scherb et al. | |
| 6,855,229 | B2 | 2/2005 | McKay et al. | |
| 7,207,356 | B2 * | 4/2007 | Patel et al. | 139/383 A |
| 7,294,237 | B2 | 11/2007 | Herman et al. | |
| 2003/0033727 | A1 | 2/2003 | Stelljes, Jr. et al. | |
| 2003/0051848 | A1 | 3/2003 | Watanabe | |
| 2003/0056911 | A1 | 3/2003 | Hermans et al. | |
| 2003/0056925 | A1 | 3/2003 | Beck | |
| 2003/0070781 | A1 | 4/2003 | Hermans et al. | |
| 2003/0136018 | A1 | 7/2003 | Herman et al. | |
| 2004/0152574 | A1 | 8/2004 | Beck et al. | |
| 2004/0173333 | A1 | 9/2004 | Hermans et al. | |
| 2004/0180596 | A1 | 9/2004 | Beck | |
| 2004/0237210 | A1 | 12/2004 | Thoroe-Scherb et al. | |
| 2005/0126031 | A1 | 6/2005 | Herman et al. | |
| 2005/0167061 | A1 | 8/2005 | Scherb et al. | |
| 2005/0167062 | A1 | 8/2005 | Herman et al. | |
| 2005/0167066 | A1 | 8/2005 | Herman et al. | |
| 2005/0167068 | A1 | 8/2005 | Herman et al. | |
| 2006/0085998 | A1 | 4/2006 | Herman et al. | |
| 2006/0085999 | A1 | 4/2006 | Scherb et al. | |
| 2006/0086473 | A1 | 4/2006 | Herman et al. | |
| 2007/0068645 | A1 | 3/2007 | Herman et al. | |
| 2007/0240842 | A1 * | 10/2007 | Scherb et al. | 162/203 |

FOREIGN PATENT DOCUMENTS

| | | |
|---|---|---|
| DE | 196 27 891 | 1/1998 |
| DE | 198 45 954 | 4/2000 |
| DE | 199 46 979 | 4/2001 |
| DE | 101 29 613 | 1/2003 |
| EP | 0 658 649 | 6/1995 |
| EP | 0 878 579 | 11/1998 |
| EP | 1 293 602 | 3/2003 |
| EP | 1 518 960 | 3/2005 |
| GB | 2141749 | 1/1985 |
| WO | 03/054292 | 7/2003 |
| WO | 03/062528 | 7/2003 |
| WO | 2004/038093 | 5/2004 |
| WO | 2005/075732 | 8/2005 |
| WO | 2005/075736 | 8/2005 |
| WO | 2005/075737 | 8/2005 |

OTHER PUBLICATIONS

U.S. Appl. No. 11/380,835, filed Apr. 28, 2006 in the name of H. Walkenhaus et al.

* cited by examiner

* Wefts 4 & 9 require larger diam yarns

Fig. 31

| Yarn details | No/cm | Diam (mm) | Material Type | % Cover | % by Weight |
|---|---|---|---|---|---|
| Warp: | 16,3 | 0,35 | PET | 57,05 | 44 |
| Weft: | 14 | 0,41 | PET | 57,40 | 56 |

Fabric Details

| | Warp | Weft |
|---|---|---|
| Aperture size (mm x mm): | 0,26 | 0,30 |
| Open Area % : | 18,2 | |
| Air permeability (cfm): | 502 | |
| Thickess (mm): | 0,85 | |
| Basis Weight (g/m$^2$): | 545 | |

Fig. 32

| Yarn details | No/cm | Diam (mm) | Material Type | % Cover | % by Weight |
|---|---|---|---|---|---|
| Warp: | 16,5 | 0,35 | PET | 57,75 | 42 |
| Weft: | 12,1 | 0,45 | PET | 54,45 | 58 |

Fabric Details

| | Warp | Weft |
|---|---|---|
| Aperture size (mm x mm): | 0,25 | 0,37 |
| Open Area % : | 19,1 | |
| Air permeability (cfm): | 540 | |
| Warp Breaking Strength N/cm: | 1070 | |
| Warp % Extension at Break: | 21,9 | |
| Thickess (mm): | 0,90 | |
| Basis Weight (g/m$^2$): | 560 | |

Fig. 33

| Yarn details | No/cm | Diam (mm) | Material Type | % Cover | % by Weight |
|---|---|---|---|---|---|
| Warp: | 14,2 | 0,40 | PET | 56,80 | 43 |
| Weft: | 13,7 | 0,45 | PET | 61,65 | 57 |

Fabric Details

| | Warp | Weft |
|---|---|---|
| Aperture size (mm x mm): | 0,30 | 0,28 |
| Open Area % : | 16,6 | |
| Air permeability (cfm): | 715 | |
| Thickess (mm): | 1,05 | |
| Basis Weight (g/m$^2$): | 628 | |

Fig. 34

| Yarn details | No/cm | Diam (mm) | Material Type | % Cover |
|---|---|---|---|---|
| Warp: | 18,5 | 0,45 | PET | 83,25 |
| Weft: | 9,8 | 0,60 | PET | 58,80 |

Fabric Details

| | Warp | Weft |
|---|---|---|
| Aperture size (mm x mm): | 0,09 | 0,42 |
| Open Area % : | 6,90 | |
| Air permeability (cfm): | 335 | |
| Fibre Support Index (FSI): | 57,0 | |
| Draimage Index (DI): | 8,0 | |
| Thickess (mm): | 1,40 | |

Fig. 35

| Yarn details | No/cm | Diam (mm) | Material Type | % Cover |
|---|---|---|---|---|
| Warp: | 15,75 | 0,35 | PET | 55,13 |
| Weft 1: | 11,02 | 0,35 | PET | 50,95 |
| Weft 2: | 2,754 | 0,45 | PET | |
| Total number of wefts: | 13,77 | | | |

Fabric Details

| | Warp | Weft |
|---|---|---|
| Aperture size (mm x mm): | 0,28 | 0,63 |
| Open Area % : | 22,01 | |
| Air permeability (cfm): | 770 | |
| Fibre Support Index (FSI): | 65,0 | |
| Draimage Index (DI): | 24,0 | |
| Thickess (mm): | 1,24 | |

FORMING FABRIC AND/OR TISSUE MOLDING BELT AND/OR MOLDING BELT FOR USE ON AN ATMOS SYSTEM

BACKGROUND OF THE INVENTION

1. Field of the Invention

The present invention relates to a paper machine, and, more particularly, to a forming fabric for manufacturing tissue and toweling. The present invention also relates to a molding belt for use in a belt press in a paper machine. The present invention also relates to a forming fabric which has good resistance to pressure, excessive tensile strain forces, and which can withstand wear/hydrolysis effects that are experienced in an ATMOS system. The present invention also relates to a forming fabric for the manufacture of tissue or towel grades utilizing a through-air drying (TAD) system. The fabric has key parameters which include permeability, compression resistance, distortion resistance, and resistance to heat and hydrolysis.

2. Description of the Related Art

The manufacture of tissue utilizes an improved technology called TAD, i.e., through air drying process. This process increases paper quality due to the higher bulk of the tissue paper. As a result, TAD sets the standard for high grade tissue. The use of a TAD forming fabric in the manufacture of TAD tissue products is well known in the art and has been used commercially for years.

In a wet pressing operation, a fibrous web sheet is compressed at a press nip to the point where hydraulic pressure drives water out of the fibrous web. It has been recognized that conventional wet pressing methods are inefficient in that only a small portion of a roll's circumference is used to process the paper web. To overcome this limitation, some attempts have been made to adapt a solid impermeable belt to an extended nip for pressing the paper web and dewater the paper web. A problem with such an approach is that the impermeable belt prevents the flow of a drying fluid, such as air through the paper web. Extended nip press (ENP) belts are used throughout the paper industry as a way of increasing the actual pressing dwell time in a press nip. A shoe press is the apparatus that provides the ability of the ENP belt to have pressure applied therethrough, by having a stationary shoe that is configured to the curvature of the hard surface being pressed, for example, a solid press roll. In this way, the nip can be extended 120 mm for tissue, and up to 250 mm for flap papers beyond the limit of the contact between the press rolls themselves. An ENP belt serves as a roll cover on the shoe press. This flexible belt is lubricated by an oil shower on the inside to prevent frictional damage. The belt and shoe press are non-permeable members, and dewatering of the fibrous web is accomplished almost exclusively by the mechanical pressing thereof.

WO 03/062528 (whose disclosure is hereby expressly incorporated by reference in its entirety), for example, discloses a method of making a three dimensional surface structured web wherein the web exhibits improved caliper and absorbency. This document discusses the need to improve dewatering with a specially designed advanced dewatering system. The system uses a Belt Press which applies a load to the back side of the structured fabric during dewatering. The belt and the structured fabric are permeable. The belt can be a spiral link fabric and can be a permeable ENP belt in order to promote vacuum and pressing dewatering simultaneously. The nip can be extended well beyond the shoe press apparatus. However, such a system with the ENP belt has disadvantages, such as a limited open area.

It is also known in the prior art to utilize a through air drying process (TAD) for drying webs, especially tissue webs. Huge TAD-cylinders are necessary, however, and as well as a complex air supply and heating system. This system also requires a high operating expense to reach the necessary dryness of the web before it is transferred to a Yankee Cylinder, which drying cylinder dries the web to its end dryness of approximately 97%. On the Yankee surface, also the creping takes place through a creping doctor.

The machinery of the TAD system is very expensive and costs roughly double that of a conventional tissue machine. Also, the operational costs are high, because with the TAD process it is necessary to dry the web to a higher dryness level than it would be appropriate with the through air system in respect of the drying efficiency. The reason is the poor CD moisture profile produced by the TAD system at low dryness level. The moisture CD profile is only acceptable at high dryness levels up to 60%. At over 30%, the impingement drying by the hood of the Yankee is much more efficient.

The max web quality of a conventional tissue manufacturing process are as follows: the bulk of the produced tissue web is less than 9 $cm^3/g$. The water holding capacity (measured by the basket method) of the produced tissue web is less than 9 (g $H_2O$/g fiber).

The advantage of the TAD system, however, results in a very high web quality especially with regard to high bulk, water holding capacity.

What is needed in the art is a belt, which provides enhanced dewatering of a continuous web.

WO 2005/075732, the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because the pressure applied belt press and hot air is blown through the web in the belt press.

WO2005/075737, the disclosure of which is hereby expressly incorporated by reference in its entirety, discloses a structured molding fabric which can create a more three-dimensionally oriented sheet.

WO2005/075736 discloses an ATMOS system which uses a belt press. A forming fabric is disclosed as a significant feature of the system.

Molding belts are known in the art but have not been used to impart a mark, impression, or an embossing in the paper web as part of a "belt sandwich" structure. A belt-sandwich incorporates at least two other fabrics such as a high tension belt and a dewatering belt in an extended nip formed by either a rotating roll or a stationary shoe. Such an arrangement is utilized in an ATMOS papermaking process

SUMMARY OF THE INVENTION

Rather than relying on a mechanical shoe for pressing, the invention allows for the use a permeable belt as the pressing element. The belt is tensioned against a suction roll so as to form a Belt Press. This allows for a much longer press nip, e.g., ten times longer than a shoe press and twenty times longer than a conventional press, which results in much lower peak pressures, i.e., 1 bar instead of 30 bar for a conventional press and 15 bar for a shoe press, all for tissue. It also has the desired advantage of allowing air flow through the web, and into the press nip itself, which is not the case with typical Shoe Presses or a conventional press like the suction press roll against a solid Yankee dryer. The preferred permeable belt is a spiral link fabric.

There is a limit on vacuum dewatering (approximately 25% solids on a TAD fabric and 30% on a dewatering fabric) and the secret to reaching 35% or more in solids with this concept while maintaining TAD like quality, is to use a very long press nip formed by a permeable belt. This can be 10 times longer than a shoe press and 20 times longer than a conventional press. The pick pressure should also be very low, i.e., 20 times lower than a shore press and 40 times lower than a conventional press. It is also very important to provide air flow through the nip. The efficiency of the arrangement of the invention is very high because it utilizes a very long nip combined with air flow through the nip. This is superior to a shoe press arrangement or to an arrangement which uses a suction press roll against a Yankee dryer wherein there is no air flow through the nip. The permeable belt can be pressed over a hard structured fabric (e.g., a TAD fabric) and over a soft, thick and resilient dewatering fabric while the paper sheet is arranged therebetween. This sandwich arrangement of the fabrics is important. The invention also takes advantage of the fact that the mass of fibers remain protected within the body (valleys) of the structured fabric and there is only a slightly pressing which occurs between the prominent points of the structured fabric (valleys). These valleys are not too deep so as to avoid deforming the fibers of the sheet plastically and to avoid negatively impacting the quality of the paper sheet, but not so shallow so as to take-up the excess water out of the mass of fibers. Of course, this is dependent on the softness, compressibility and resilience of the dewatering fabric.

The present invention also provides for a specially designed permeable ENP belt which can be used on a Belt Press in an advanced dewatering system or in an arrangement wherein the web is formed over a structured fabric. The permeable ENP belt can also be used in a No Press/Low press Tissue Flex process.

The present invention also provides a high strength permeable press belt with open areas and contact areas on a side of the belt.

The invention comprises, in one form thereof, a belt press including a roll having an exterior surface and a permeable belt having a side in pressing contact over a portion of the exterior surface of the roll. The permeable belt has a tension of at least approximately 30 KN/m applied thereto. The side of the permeable belt has an open area of at least approximately 25%, and a contact area of at least approximately 10%, and preferably approximately 50% open area and approximately 50% contact area, wherein the open area comprises a total area which is encompassed by the openings and grooves (i.e., that portion of the surface which is not designed to compress the web to same extent as the contact areas) and wherein the contact area is defined by the land areas of the surface of the belt, i.e., the total area of the surface of the belt between the openings and/or the grooves. With an ENP belt, it is not possible to use a 50% open area and a 50% contact area. On the other hand, this is possible with, e.g., a link fabric.

An advantage of the present invention is that it allows substantial airflow therethrough to reach the fibrous web for the removal of water by way of a vacuum, particularly during a pressing operation.

Another advantage is that the permeable belt allows a significant tension to be applied thereto.

Yet another advantage is that the permeable belt has substantial open areas adjacent to contact areas along one side of the belt.

Still yet another advantage of the present invention is that the permeable belt is capable of applying a line force over an extremely long nip, thereby ensuring a long dwell time in which pressure is applied against the web as compared to a standard shoe press.

The invention also provides for a belt press for a paper machine, wherein the belt press comprises a roll comprising an exterior surface. A permeable belt comprises a first side and is guided over a portion of the exterior surface of the roll. The permeable belt has a tension of at least approximately 30 KN/m. The first side has an open area of at least approximately 25% a contact area of at least approximately 10%.

The first side may face the exterior surface and the permeable belt may exert a pressing force on the roll. The permeable belt may comprise through openings. The permeable belt may comprise through openings arranged in a generally regular symmetrical pattern. The permeable belt may comprises generally parallel rows of through openings, whereby the rows are oriented along a machine direction. The permeable belt may exert a pressing force on the roll in the range of between approximately 30 KPa and approximately 300 KPa (approximately 0.3 bar to approximately 1.5 bar and preferably approximately 0.07 to approximately 1 bar). The permeable belt may comprise through openings and a plurality of grooves, each groove intersecting a different set of through openings. The first side may face the exterior surface and the permeable belt may exert a pressing force on the roll. The plurality of grooves may be arranged on the first side. Each of the plurality of grooves may comprise a width, and each of the through openings may comprise a diameter, and wherein the diameter is greater than the width.

The tension of the belt is greater than approximately 30 KN/m, and preferably 50 KN/m. The roll may comprise a vacuum roll. The roll may comprise a vacuum roll having an interior circumferential portion. The vacuum roll may comprise at least one vacuum zone arranged within said interior circumferential portion. The roll may comprise a vacuum roll having a suction zone. The suction zone may comprise a circumferential length of between approximately 200 mm and approximately 2500 mm. The circumferential length may be in the range of between approximately 800 mm and approximately 1800 mm. The circumferential length may be in the range of between approximately 1200 mm and approximately 1600 mm. The permeable belt may comprise at least one of a polyurethane extended nip belt or a spiral link fabric. The permeable belt may comprise a polyurethane extended nip belt which includes a plurality of reinforcing yarns embedded therein. The plurality of reinforcing yarns may comprise a plurality of machine direction yarns and a plurality of cross direction yarns. The permeable belt may comprise a polyurethane extended nip belt having a plurality of reinforcing yarns embedded therein, said plurality of reinforcing yarns being woven in a spiral link manner. The permeable belt may comprise a spiral link fabric (which importantly produces good results) or two or more spiral link fabrics.

The belt press may further comprise a first fabric and a second fabric traveling between the permeable belt and the roll. The first fabric has a first side and a second side. The first side of the first fabric is in at least partial contact with the exterior surface of the roll. The second side of the first fabric is in at least partial contact with a first side of a fibrous web. The second fabric has a first side and a second side. The first side of the second fabric is in at least partial contact with the first side of the permeable belt. The second side of the second fabric is in at least partial contact with a second side of the fibrous web. It is also possible to have a second permeable belt on top of the first fabric The first fabric may comprise a permeable dewatering belt. The second fabric may comprise a structured fabric. The fibrous web may comprise a tissue web or hygiene web. The invention also provides for a fibrous material drying arrangement comprising an endlessly circulating permeable extended nip press (ENP) belt guided over a roll. The ENP belt is subjected to a tension of at least approximately 30 KN/m. The ENP belt comprises a side having an open area of at least approximately 25% and a contact area of at least approximately 10%.

The invention also provides for a permeable extended nip press (ENP) belt which is capable of being subjected to a tension of at least approximately 30 KN/m, wherein the permeable ENP belt comprises at least one side comprising an open area of at least approximately 25% and a contact area of at least approximately 10%.

The open area may be defined by through openings and the contact area is defined by a planar surface. The open area may be defined by through openings and the contact area is defined by a planar surface without openings, recesses, or grooves. The open area may be defined by through openings and grooves, and the contact area is defined by a planar surface without openings, recesses, or grooves. The open area may be between approximately 15% and approximately 50%, and the contact area may be between approximately 50% and approximately 85%. The open area may be between approximately 30% and approximately 85%, and the contact area may be between approximately 15% and approximately 70%. The open area may be between approximately 45% and approximately 85%, and the contact area may be between approximately 15% and approximately 55%. The open area may be between approximately 50% and approximately 65%, and the contact area may be between approximately 35% and approximately 50%. The permeable ENP belt may comprise a spiral link fabric. The open area may be between approximately 10% and approximately 40%, and the contact area is between approximately 60% and approximately 90%. The permeable ENP belt may comprise through openings arranged in a generally symmetrical pattern. The permeable ENP belt may comprise through openings arranged in generally parallel rows relative to a machine direction. The permeable ENP belt may comprise an endless circulating belt.

The permeable ENP belt may comprise through openings and the at least one side of the permeable ENP belt may comprise a plurality of grooves, each of the plurality of grooves intersects a different set of through hole. Each of the plurality of grooves may comprise a width, and each of the through openings may comprise a diameter, and wherein the diameter is greater than the width. Each of the plurality of grooves extend into the permeable ENP belt by an amount which is less than a thickness of the permeable belt.

The tension may be greater than approximately 30 KN/m and is preferably greater than approximately 50 KN/m, or greater than approximately 60 KN/m, or greater than approximately 80 KN/m. The permeable ENP belt may comprise a flexible reinforced polyurethane member. The permeable ENP belt may comprise a flexible spiral link fabric. The permeable ENP belt may comprise a flexible polyurethane member having a plurality of reinforcing yarns embedded therein. The plurality of reinforcing yarns may comprise a plurality of machine direction yarns and a plurality of cross direction yarns. The permeable ENP belt may comprise a flexible polyurethane material and a plurality of reinforcing yarns embedded therein, said plurality of reinforcing yarns being woven in a spiral link manner.

The invention also provides for a method of subjecting a fibrous web to pressing in a paper machine, wherein the method comprises applying pressure against a contact area of the fibrous web with a portion of a permeable belt, wherein the contact area is at least approximately 10% of an area of said portion and moving a fluid through an open area of said permeable belt and through the fibrous web, wherein said open area is at least approximately 25% of said portion, wherein, during the applying and the moving, said permeable belt has a tension of at least approximately 30 KN/m.

The contact area of the fibrous web may comprise areas which are pressed more by the portion than non-contact areas of the fibrous web. The portion of the permeable belt may comprise a generally planar surface which includes no openings, recesses, or grooves and which is guided over a roll. The fluid may comprises air. The open area of the permeable belt may comprise through openings and grooves. The tension may be greater than approximately 50 KN/m.

The method may further comprise rotating a roll in a machine direction, wherein said permeable belt moves in concert with and is guided over or by said roll. The permeable belt may comprise a plurality of grooves and through openings, each of said plurality of grooves being arranged on a side of the permeable belt and intersecting with a different set of through openings. The applying and the moving may occur for a dwell time which is sufficient to produce a fibrous web solids level in the range of between approximately 25% and approximately 55%. Preferably, the solids level may be greater than approximately 30%, and most preferably it is greater than approximately 40%. These solids levels may be obtained whether the permeable belt is used on a belt press or on a No Press/Low Press arrangement. The permeable belt may comprises a spiral link fabric.

The invention also provides for a method of pressing a fibrous web in a paper machine, wherein the method comprises applying a first pressure against first portions of the fibrous web with a permeable belt and a second greater pressure against second portions of the fibrous web with a pressing portion of the permeable belt, wherein an area of the second portions is at least approximately 25% of an area of the first portions and moving air through open portions of said permeable belt, wherein an area of the open portions is at least approximately 25% of the pressing portion of the permeable belt which applies the first and second pressures, wherein, during the applying and the moving, the permeable belt has a tension of at least approximately 30 KN/m.

The tension may be greater than approximately 50 KN/m or may be greater than approximately 60 KN/m or may be greater than approximately 80 KN/m. The method may further comprise rotating a roll in a machine direction, said permeable belt moving in concert with said roll. The area of the open portions may be at least approximately 50%. The area of the open portions may be at least approximately 70%. The second greater pressure may be in the range of between approximately 30 KPa and approximately 150 KPa. The moving and the applying may occur substantially simultaneously.

The method may further comprise moving the air through the fibrous web for a dwell time which is sufficient to produce a fibrous web solids in the range of between approximately 25% and approximately 55%. The dwell time may be equal to or greater than approximately 40 ms and is preferably equal to or greater than approximately 50 ms. Air flow can be approximately 150 $m^3$/min per meter machine width.

The invention also provides for a method of drying a fibrous web in a belt press which includes a roll and a permeable belt comprising through openings, wherein an area of the through openings is at least approximately 25% of an area of a pressing portion of the permeable belt, and wherein the permeable belt is tensioned to at least approximately 30 KN/m, wherein the method comprises guiding at least the pressing portion of the permeable belt over the roll, moving the fibrous web between the roll and the pressing portion of the permeable belt, subjecting at least approximately 25% of the fibrous web to a pressure produced by portions of the permeable belt which are adjacent to the through openings, and moving a fluid through the through openings of the permeable belt and the fibrous web.

The invention also provides for a method of drying a fibrous web in a belt press which includes a roll and a permeable belt comprising through openings and grooves, wherein an area of the through openings is at least approximately 25% of an area of a pressing portion of the permeable belt, and wherein the permeable belt is tensioned to at least approximately 30 KN/m, wherein the method comprises guiding at least the pressing portion of the permeable belt over the roll, moving the fibrous web between the roll and the pressing portion of the permeable belt, subjecting at least approximately 10% of the fibrous web to a pressure produced by portions of the permeable belt which are adjacent to the through openings and the grooves, and moving a fluid through the through openings and the grooves of the permeable belt and the fibrous web.

According to another aspect of the invention, there is provided a more efficient dewatering process, preferably for the tissue manufacturing process, wherein the web achieves a dryness in the range of up to about 40% dryness. The process according to the invention is less expensive in machinery and in operational costs, and provides the same web quality as the TAD process. The bulk of the produced tissue web according to the invention is greater than approximately 10 g/cm$^3$, up to the range of between approximately 14 g/cm$^3$ and approximately 16 g/cm$^3$. The water holding capacity (measured by the basket method) of the produced tissue web according to the invention is greater than approximately 10 (g $H_2O$/g fiber), and up to the range of between approximately 14 (g $H_2O$/g fiber) and approximately 16 (g $H_2O$/g fiber).

The invention thus provides for a new dewatering process, for thin paper webs, with a basis weight less than approximately 42 g/m$^2$, preferably for tissue paper grades. The invention also provides for an apparatus which utilizes this process and also provides for elements with a key function for this process.

A main aspect of the invention is a press system which includes a package of at least one upper (or first), at least one lower (or second) fabric and a paper web disposed therebetween. A first surface of a pressure producing element is in contact with the at least one upper fabric. A second surface of a supporting structure is in contact with the at least one lower fabric and is permeable. A differential pressure field is provided between the first and the second surface, acting on the package of at least one upper and at least one lower fabric, and the paper web therebetween, in order to produce a mechanical pressure on the package and therefore on the paper web. This mechanical pressure produces a predetermined hydraulic pressure in the web, whereby the contained water is drained. The upper fabric has a bigger roughness and/or compressibility than the lower fabric. An airflow is caused in the direction from the at least one upper to the at least one lower fabric through the package of at least one upper and at least one lower fabric and the paper web therebetween.

Different possible modes and additional features are also provided. For example, the upper fabric may be permeable, and/or a so-called "structured fabric". By way of non-limiting examples, the upper fabric can be e.g., a TAD fabric, a membrane or fabric which includes a permeable base fabric and a lattice grid attached thereto and which is made of polymer such as polyurethane. The lattice grid side of the fabric can be in contact with a suction roll while the opposite side contacts the paper web. The lattice grid can also be oriented at an angle relative to machine direction yarns and cross-direction yarns. The base fabric is permeable and the lattice grid can be a anti-rewet layer. The lattice can also be made of a composite material, such as an elastomeric material. The lattice grid can itself include machine direction yarns with the composite material being formed around these yarns. With a fabric of the above mentioned type it is possible to form or create a surface structure that is independent of the weave patterns. At least for tissue, an important consideration is to provide a soft layer in contact with the sheet.

The upper fabric may transport the web to and from the press system. The web can lie in the three-dimensional structure of the upper fabric, and therefore it is not flat but has also a three-dimensional structure, which produces a high bulky web. The lower fabric is also permeable. The design of the lower fabric is made to be capable of storing water. The lower fabric also has a smooth surface. The lower fabric is preferably a felt with a batt layer. The diameter of the batt fibers of the lower fabric are equal to or less than approximately 11 dtex, and can preferably be equal to or lower than approximately 4.2 dtex, or more preferably be equal to or less than approximately 3.3 dtex. The batt fibers can also be a blend of fibers. The lower fabric can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the lower fabric and/or of the lower fabric itself can be equal to or greater than approximately 35 m$^2$/m$^2$ felt area, and can preferably be equal to or greater than approximately 65 m$^2$/m$^2$ felt area, and can most preferably be equal to or greater than approximately 100 m$^2$/m$^2$ felt area. The specific surface of the lower fabric should be equal to or greater than approximately 0.04 m$^2$/g felt weight, and can preferably be equal to or greater than approximately 0.065 m$^2$/g felt weight, and can most preferably be equal to or greater than approximately 0.075 m$^2$/g felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the lower fabric should be considered. This is important in order to dewater the web efficiently to a high dryness level. A hard surface would not press the web between the prominent points of the structured surface of the upper fabric. On the other hand, the felt should not be pressed too deep into the three-dimensional structure to avoid loosing bulk and therefore quality, e.g., water holding capacity.

The compressibility (thickness change by force in mm/N) of the upper fabric is lower than that of the lower fabric. The dynamic stiffness K*[N/mm] as a value for the compressibility of the upper fabric can be more than or equal to 3,000 N/mm and lower than the lower fabric. This is important in order to maintain the three-dimensional structure of the web, i.e., to ensure that the upper belt is a stiff structure.

The resilience of the lower fabric should be considered. The dynamic modulus for compressibility G*[N/mm$^2$] as a value for the resilience of the lower fabric is acceptable if more than or equal to 0.5 $N/mm^2$, preferable resilience is more than or equal to 2 $N/mm^2$, and most preferably the resilience is more than or equal to 4 $N/mm^2$. The density of the lower fabric should be equal to or higher than approximately 0.4 $g/cm^3$, and is preferably equal to or higher than approximately 0.5 $g/cm^3$, and is ideally equal to or higher than approximately 0.53 $g/cm^3$. This can be advantageous at web speeds of greater than approximately 1200 m/min. A reduced felt volume makes it easier to take the water away from the felt by the air flow, i.e., to get the water through the felt. Therefore the dewatering effect is smaller. The permeability of the lower fabric can be lower than approximately 80 cfm, preferably lower than approximately 40 cfm, and ideally equal to or lower than approximately 25 cfm. A reduced permeability makes it easier to take the water away from the felt by the air flow, i.e., to get the water through the felt. As a result, the re-wetting effect is smaller. A too high permeability, however, would lead to a too high air flow, less vacuum level for a given vacuum pump, and less dewatering of the felt because of the too open structure.

The second surface of the supporting structure can be flat and/or planar. In this regard, the second surface of the supporting structure can be formed by a flat suction box. The second surface of the supporting structure can preferably be curved. For example, the second surface of the supporting structure can be formed or run over a suction roll or cylinder whose diameter is, e.g., approximately 1 m or more or approximately 1.2 m or more. For example, for a production machine with a 200 inch width, the diameter can be in the range of approximately 1.5 m or more. The suction device or cylinder may comprise at least one suction zone. It may also comprise two suction zones. The suction cylinder may also include at least one suction box with at least one suction arc. At least one mechanical pressure zone can be produced by at least one pressure field (i.e., by the tension of a belt) or through the first surface by, e.g., a press element. The first surface can be an impermeable belt, but with an open surface toward the first fabric, e.g., a grooved or a blind drilled and grooved open surface, so that air can flow from outside into the suction arc. The first surface can be a permeable belt. The belt may have an open area of at least approximately 25%, preferably greater than approximately 35%, most preferably greater than approximately 50%. The belt may have a contact area of at least approximately 10%, at least approximately 25%, and preferably between approximately 50% and approximately 85% in order to have a good pressing contact.

In addition, the pressure field can be produced by a pressure element, such as a shoe press or a roll press. This has the following advantage: If a very high bulky web is not required, this option can be used to increase dryness and therefore production to a desired value, by adjusting carefully the mechanical pressure load. Due to the softer second fabric the web is also pressed at least partly between the prominent points (valleys) of the three-dimensional structure. The additional pressure field can be arranged preferably before (no re-wetting), after or between the suction area. The upper permeable belt is designed to resist a high tension of more than approximately 30 KN/m, and preferably approximately 50 KN/m, or higher e.g., approximately 80 KN/m. By utilizing this tension, a pressure is produced of greater than approximately 0.3 bar, and preferably approximately 1 bar, or higher, may be e.g., approximately 1.5 bar. The pressure "p" depends on the tension "S" and the radius "R" of the suction roll according to the well known equation, $p=S/R$. As can be seen from the equation, the greater the roll diameter the greater the tension need to be to achieve the required pressure. The upper belt can also be a stainless steel and/or a metal band and/or a polymeric band. The permeable upper belt can be made of a reinforced plastic or synthetic material. It can also be a spiral linked fabric. Preferably, the belt can be driven to avoid shear forces between the first and second fabrics and the web. The suction roll can also be driven. Both of these can also be driven independently.

The first surface can be a permeable belt supported by a perforated shoe for the pressure load.

The air flow can be caused by a non-mechanical pressure field alone or in combination as follows: with an underpressure in a suction box of the suction roll or with a flat suction box, or with an overpressure above the first surface of the pressure producing element, e.g., by a hood, supplied with air, e.g., hot air of between approximately 50 degrees C. and approximately 180 degrees C., and preferably between approximately 120 degrees C. and approximately 150 degrees C., or also preferably steam. Such a higher temperature is especially important and preferred if the pulp temperature out of the headbox is less than about 35 degrees C. This is the case for manufacturing processes without or with less stock refining. Of course, all or some of the above-noted features can be combined.

The pressure in the hood can be less than approximately 0.2 bar, preferably less than approximately 0.1, most preferably less than approximately 0.05 bar. The supplied air flow to the hood can be less or preferable equal to the flow rate sucked out of the suction roll by vacuum pumps. A desired air flow is approximately 140 $m^3$/min per meter of machine width. Supplied air flow to the hood at atmospheric pressure can be equal to approximately 500 $m^3$/min per meter of machine width. The flow rate sucked out of the suction roll by a vacuum pump can have a vacuum level of approximately 0.6 bar at approximately 25 degrees C.

The suction roll can be wrapped partly by the package of fabrics and the pressure producing element, e.g., the belt, whereby the second fabric has the biggest wrapping arc "$a^1$" and leaves the arc zone lastly. The web together with the first fabric leaves secondly, and the pressure producing element leaves firstly. The arc of the pressure producing element is bigger than arc of the suction box. This is important, because at low dryness, the mechanical dewatering is more efficient than dewatering by airflow. The smaller suction arc "$a_2$" should be big enough to ensure a sufficient dwell time for the air flow to reach a maximum dryness. The dwell time "T" should be greater than approximately 40 ms, and preferably is greater than approximately 50 ms. For a roll diameter of approximately 1.2 m and a machine speed of approximately 1200 m/min, the arc "$a_2$" should be greater than approximately 76 degrees, and preferably greater than approximately 95 degrees. The formula is $a_2$=[dwell time*speed*360/circumference of the roll].

The second fabric can be heated e.g., by steam or process water added to the flooded nip shower to improve the dewatering behavior. With a higher temperature, it is easier to get the water through the felt. The belt could also be heated by a heater or by the hood or steam box. The TAD-fabric can be heated especially in the case when the former of the tissue machine is a double wire former. This is because, if it is a crescent former, the TAD fabric will wrap the forming roll and will therefore be heated by the stock which is injected by the headbox.

There are a number of advantages of this process describe herein. In the prior art TAD process, ten vacuum pumps are needed to dry the web to approximately 25% dryness. On the other hand, with the advanced dewatering system of the invention, only six vacuum pumps are needed to dry the web to approximately 35%. Also, with the prior art TAD process, the web should preferably be dried up to a high dryness level of between about 60% and about 75%, otherwise a poor moisture cross profile would be created. This way a lot of energy is wasted and the Yankee and hood capacity is only used marginally. The system of the instant invention makes it possible to dry the web in a first step up to a certain dryness level of between approximately 30 and approximately 40%, with a good moisture cross profile. In a second stage, the dryness can be increased to an end dryness of more than approximately 90% using a conventional Yankee/hood (impingement) dryer combined the inventive system. One way to produce this dryness level, can include more efficient impingement drying via the hood on the Yankee.

With the system according to the invention, there is no need for through air drying. A paper having the same quality as produced on a TAD machine is generated with the inventive system utilizing the whole capability of impingement drying which is more efficient in drying the sheet from 35% to more than 90% solids.

The invention also provides for a belt press for a paper machine, wherein the belt press comprises a vacuum roll comprising an exterior surface and at least one suction zone. A permeable belt comprises a first side and is guided over a portion of the exterior surface of the vacuum roll. The permeable belt has a tension of at least approximately 30 KN/m. The first side has an open area of at least approximately 25% a contact area of at least approximately 10%.

The at least one suction zone may comprises a circumferential length of between approximately 200 mm and approximately 2,500 mm. The circumferential length may define an arc of between approximately 80 degrees and approximately 180 degrees. The circumferential length may define an arc of between approximately 80 degrees and approximately 130 degrees. The at least one suction zone may be adapted to apply vacuum for a dwell time which is equal to or greater than approximately 40 ms. The dwell time may be equal to or greater than approximately 50 ms. The permeable belt may exert a pressing force on the vacuum roll for a first dwell time which is equal to or greater than approximately 40 ms. The at least one suction zone may be adapted to apply vacuum for a second dwell time which is equal to or greater than approximately 40 ms. The second dwell time may be equal to or greater than approximately 50 ms. The first dwell time may be equal to or greater than approximately 50 ms. The permeable belt may comprise at least one spiral link fabric. The at least one spiral link fabric may comprise a synthetic, a plastic, a reinforced plastic, and/or a polymeric material. The at least one spiral link fabric may comprise stainless steel. The at least one spiral link fabric may comprise a tension which is between approximately 30 KN/m and approximately 80 KN/m. The tension may be between approximately 35 KN/m and approximately 70 KN/m.

The invention also provides for a method of pressing and drying a paper web, wherein the method comprises pressing, with a pressure producing element, the paper web between at least one first fabric and at least one second fabric and simultaneously moving a fluid through the paper web and the at least one first and second fabrics.

The pressing may occur for a dwell time which is equal to or greater than approximately 40 ms. The dwell time may be equal to or greater than approximately 50 ms. The simultaneously moving may occur for a dwell time which is equal to or greater than approximately 40 ms. This dwell time may be equal to or greater than approximately 50 ms. The pressure producing element may comprise a device which applies a vacuum. The vacuum may be greater than approximately 0.5 bar. The vacuum may be greater than approximately 1 bar. The vacuum may be greater than approximately 1.5 bar.

TAD technology developed as a completely new set up for tissue machinery because older machines could not be rebuilt due to the immense costs involved in doing so and because this older technology had very high energy consumption.

The assignee company of the instant patent application developed a technology which would allow existing machines to be rebuilt and also developed new machines that made tissue with increased paper quality and to the highest standards. Such machines, however, require different fabrics and one main aim of the invention is to provide such fabrics For example, such fabrics should has a very high resilience and/or softness in order to react properly in an environment where it experiences pressure provided by the tension belt. Such fabrics should also have very good pressure transfer characteristics in order to achieve uniform dewatering, especially when the pressure is provided by the tension belt of an ATMOS system. The fabric should also have high temperature stability so that it performs well in the temperature environments which result from the use of hot air blow boxes. A certain range of air permeability is also needed for the fabric so that when hot air is blown from above the fabric and vacuum pressure is applied to the vacuum side of the fabric (or the paper package which includes the same), the mixture of water and air (i.e., hot air) will pass through the fabric and/or package containing the fabric.

The forming fabric can be a single or multi-layered woven fabric which can withstand the high pressures, heat, moisture concentrations, and which can achieve a high level of water removal and also mold or emboss the paper web required by the Voith ATMOS paper making process. The forming fabric should also have a width stability, a suitable high permeability. The forming fabric should also preferably utilize hydrolysis and/or temperature resistant materials.

The forming fabric is utilized as part of a sandwich structure which includes at least two other belts and/or fabrics. These additional belts include a high tension belt and a dewatering belt. The sandwich structure is subjected to pressure and tension over an extended nip formed by a rotating roll or static support surface. The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll having a diameter that is between approximately 1000 mm and approximately 2500 mm, and is preferably between approximately 1400 mm and approximately 1700 mm.

The forming fabric imparts a topographical pattern into the paper sheet or web. To accomplish this, high pressures are imparted to the forming or molding fabric via a high tension belt. The topography of the sheet pattern can be manipulated by varying the specifications of the molding belt, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt and by varying the specification of the molding belt. Other factors which can influence the nature and intensity of the typographical pattern of the sheet include air temperature, air speed, air pressure, belt dwell time in the extended nip, and nip length.

The following are non-limiting characteristics and/or properties of the forming fabric: to enable suitable dewatering, the single or multi-layered fabric should have a permeability value of between approximately 100 cfm and approximately 1200 cfm, and is preferably between approximately 200 cfm and approximately 900 cfm; the forming fabric which is part of a sandwich structure with two other belts, e.g., a high tension belt and a dewatering belt, is subjected to pressure and tension over a rotating or static support surface and at an angle of wrap of between approximately 30 degrees and approximately 180 degrees and preferably between approximately 50 degrees and approximately 130 degrees; the forming fabric should have a paper surface contact area of between approximately 0.5% and approximately 90% when not under pressure or tension; the forming fabric should have an open area of between approximately 1.0% and approximately 90%.

The forming fabric is preferably a woven fabric that can be installed on an ATMOS machine as a pre-joined and/or seamed continuous and/or endless belt. Alternatively, the forming fabric can be joined in the ATMOS machine using e.g., a pin-seam arrangement or can otherwise be seamed on the machine. In order to resist the high moisture and heat generated by the ATMOS papermaking process, the woven single or multi-layered belt may utilize either hydrolysis and/or heat resistant materials. Hydrolysis resistant materials should preferably include a PET monofilament having an intrinsic viscosity value normally associated with dryer and TAD fabrics in the range of between 0.72 IV and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used. Preferably, all end groups are capped by an end capping agent that may be selected from conventionally known materials such that there are no free carboxyl end groups.

Heat resistant materials such as PPS can be utilized in the forming fabric. Other materials such as PEN, PBT, PEEK and PA can also be used to improve properties of the forming fabric such as stability, cleanliness and life. Both single polymer yarns and copolymer yarns can be used. The material for the belt need not necessarily be made from monofilament and can be a multi-filament, core and sheath, and could also be a non-plastic material, i.e., a metallic material. Similarly, the fabric may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The forming fabric can also be treated and/or coated with an additional polymeric material that is applied by e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduce drive loads. The treatment/coating can be applied to impart/improve one or several of these properties of the fabric. As indicated previously, the topographical pattern in the paper web can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Finally, one or more surfaces of the forming fabric or molding belt can be subjected to sanding and/or abrading in order to enhance surface characteristics.

The invention also provides for a belt press for a paper machine, wherein the belt press comprises a forming fabric comprising a paper web facing side and being guided over a support surface. The forming fabric comprises a permeability value of between approximately 100 cfm and approximately 1200 cfm, a paper surface contact area of between approximately 0.5% and approximately 90% when not under pressure and tension, and an open area of between approximately 1.0% and approximately 90%.

The belt press can be arranged on an ATMOS system. The belt press can also be arranged on a TAD machine. At least one surface of the forming fabric can comprise at least one of an abraded surface and a sanded surface. The paper web facing side of the forming fabric can comprise at least one of an abraded surface and a sanded surface. The permeability value can be between approximately 200 cfm and approximately 900 cfm. The forming fabric may comprise a single material. The forming fabric can comprise a monofilament material. The forming fabric can comprise a multifilament material. The forming fabric can comprise two or more different materials. The forming fabric can comprise three different materials. The forming fabric can comprise a polymeric material. The forming fabric can be treated with a polymeric material. The forming fabric can comprise a polymeric material that is applied by deposition. The forming fabric can comprise at least one of shaped yarns, generally circular shaped yarns, and non-circular shaped yarns. The forming fabric can be resistant to at least one of hydrolysis and temperatures which exceed 100 degrees C. The support surface can be static. The support surface can be arranged on a roll. The roll can be a vacuum roll having a diameter of between approximately 1000 mm and approximately 2500 mm. The vacuum roll can have a diameter of between approximately 1400 mm and approximately 1700 mm. The belt press can form an extended nip with the support surface. The extended nip can have an angle of wrap of between approximately 30 degrees and approximately 180 degrees. The angle of wrap can be between approximately 50 degrees and approximately 130 degrees. The extended nip can have a nip length of between approximately 800 mm and approximately 2500 mm. The nip length can be between approximately 1200 mm and approximately 1500 mm. The forming fabric can be an endless belt that is at least one of pre-seamed and has its ends joined on a machine which utilizes the belt press. The forming fabric can be structured and arranged to impart a topographical pattern to a web. The web can comprise at least one of a tissue web, a hygiene web, and a towel web.

The invention also provides for a fibrous material drying arrangement comprising an endlessly circulating forming fabric guided over a roll. The forming fabric comprises a permeability value of between approximately 100 cfm and approximately 1200 cfm, a paper surface contact area of between approximately 0.5% and approximately 90% when not under pressure and tension, and an open area of between approximately 1.0% and approximately 90%.

The invention also provides for a method of subjecting a fibrous web to pressing in a paper machine using the arrangement described herein, the method comprising applying pressure to the forming fabric and the fibrous web in a belt press.

The invention also provides for a method of subjecting a fibrous web to pressing in a paper machine using the belt press of the type described herein, wherein the method comprises applying pressure to the forming fabric and the fibrous web in a belt press.

The invention also provides for a forming fabric for an ATMOS system or a TAD machine, wherein the forming fabric comprises a permeability value of between approximately 100 cfm and approximately 1200 cfm, a paper surface contact area of between approximately 0.5% and approximately 90% when not under pressure and tension, and an open area of between approximately 1.0% and approximately 90%.

The invention also provides for a method of subjecting a fibrous web to pressing in a paper machine using the forming fabric of the type described herein, wherein the method comprises applying pressure to the forming fabric and the fibrous web using a belt press.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 31 shows one non-limiting embodiment of a fabric specification which can be used for the forming fabric according to the invention;

FIG. 32 shows another non-limiting embodiment of a fabric specification which can be used for the forming fabric according to the invention;

FIG. 33 shows still another non-limiting embodiment of a fabric specification which can be used for the forming fabric according to the invention;

FIG. 34 shows another non-limiting embodiment of a fabric specification which can be used for the forming fabric according to the invention; and FIG. 35 shows another non-limiting embodiment of a fabric specification which can be used for the forming fabric according to the invention.

Figure 1:
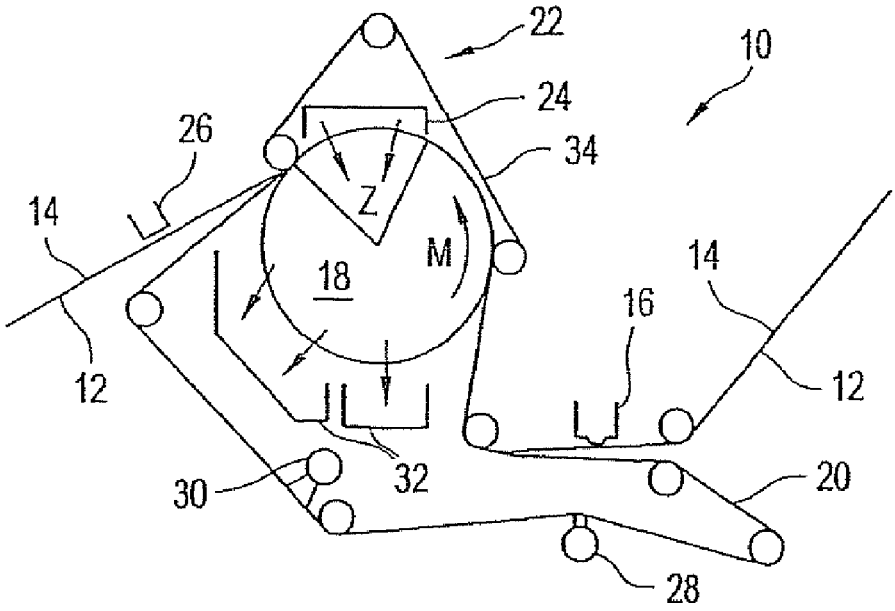
FIG. 1 is a cross-sectional schematic diagram of an advanced dewatering system with an embodiment of a belt press according to the present invention.

Corresponding reference characters indicate corresponding parts throughout the several views. The exemplary embodiments set out herein illustrate one or more acceptable or preferred embodiments of the invention, and such exemplifications are not to be construed as limiting the scope of the invention in any manner.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Referring now to the drawings, and more particularly to FIG. 1, there is shown an advanced dewatering system 10 for processing a fibrous web 12. System 10 includes a fabric 14, a suction box 16, a vacuum roll 18, a dewatering fabric 20, a belt press assembly 22, a hood 24 (which may be a hot air hood), a pick up suction box 26, a Uhle box 28, one or more shower units 30, and one or more savealls 32. The fibrous material web 12 enters system 10 generally from the right as shown in FIG. 1. Fibrous web 12 is a previously formed web (i.e., previously formed by a mechanism which is not shown) which is placed on the fabric 14. As is evident from FIG. 1, the suction device 16 provides suctioning to one side of the web 12, while the suction roll 18 provides suctioning to an opposite side of the web 12.

Fibrous web 12 is moved by fabric 14 in a machine direction M past one or more guide rolls and then past the suction box 16. At the vacuum box 16, sufficient moisture is removed from web 12 to achieve a solids level of between approximately 15% and approximately 25% on a typical or nominal 20 gram per square meter (gsm) web running. The vacuum at the box 16 provides between approximately −0.2 to approximately −0.8 bar vacuum, with a preferred operating level of between approximately −0.4 to approximately −0.6 bar.

As fibrous web 12 proceeds along the machine direction M, it comes into contact with a dewatering fabric 20. The dewatering fabric 20 can be an endless circulating belt which is guided by a plurality of guide rolls and is also guided around the suction roll 18. The dewatering belt 20 can be a dewatering fabric of the type shown and described in FIG. 13 or 14 herein. The dewatering fabric 20 can also preferably be a felt. The web 12 then proceeds toward vacuum roll 18 between the fabric 14 and the dewatering fabric 20. The vacuum roll 18 rotates along the machine direction M and is operated at a vacuum level of between approximately −0.2 to approximately −0.8 bar with a preferred operating level of at least approximately −0.4 bar, and most preferably approximately −0.6 bar. By way of non-limiting example, the thickness of the vacuum roll shell of roll 18 may be in the range of between approximately 25 mm and approximately 75 mm. The mean airflow through the web 12 in the area of the suction zone Z can be approximately 150 $m^3$/min per meter of machine width. The fabric 14, web 12 and dewatering fabric 20 are guided through a belt press 22 formed by the vacuum roll 18 and a permeable belt 34. As is shown in FIG. 1, the permeable belt 34 is a single endlessly circulating belt which is guided by a plurality of guide rolls and which presses against the vacuum roll 18 so as to form the belt press 22.

The upper fabric 14 transports the web 12 to and from the belt press system 22. The web 12 lies in the three-dimensional structure of the upper fabric 14, and therefore it is not flat but has also a three-dimensional structure, which produces a high bulky web. The lower fabric 20 is also permeable. The design of the lower fabric 20 is made to be capable of storing water. The lower fabric 20 also has a smooth surface. The lower fabric 20 is preferably a felt with a batt layer. The diameter of the batt fibers of the lower fabric 20 are equal to or less than approximately 11 dtex, and can preferably be equal to or lower than approximately 4.2 dtex, or more preferably be equal to or less than approximately 3.3 dtex. The batt fibers can also be a blend of fibers. The lower fabric 20 can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the lower fabric 20 and/or of the lower fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the lower fabric 20 should be equal to or greater than approximately 0.04 $m^2$/g felt weight, and can preferably be equal to or greater than approximately 0.065 $m^2$/g felt weight, and can most preferably be equal to or greater than approximately 0.075 $m^2$/g felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the lower fabric 20 should be considered. This is important in order to dewater the web efficiently to a high dryness level. A hard surface would not press the web 12 between the prominent points of the structured surface of the upper fabric. On the other hand, the felt should not be pressed too deep into the three-dimensional structure to avoid loosing bulk and therefore quality, e.g., water holding capacity.

The circumferential length of vacuum zone Z can be between approximately 200 mm and approximately 2500 mm, and is preferably between approximately 800 mm and approximately 1800 mm, and an even more preferably between approximately 1200 mm and approximately 1600 mm. The solids content leaving vacuum roll 18 in web 12 will vary between approximately 25% to approximately 55% depending on the vacuum pressures and the tension on permeable belt, as well as the length of vacuum zone Z and the dwell time of web 12 in vacuum zone Z. The dwell time of web 12 in vacuum zone Z is sufficient to result in this solids range of between approximately 25% and approximately 55%.

Figure 2:
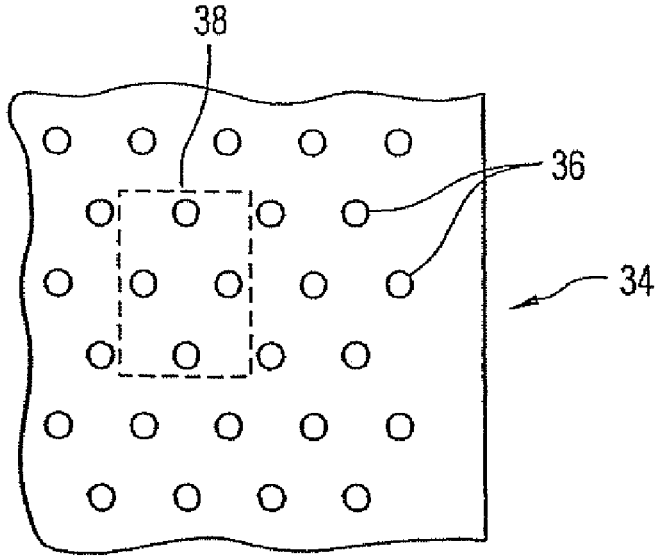
FIG. 2 is a surface view of one side of a permeable belt of the belt press of FIG. 1.
Figure 3:
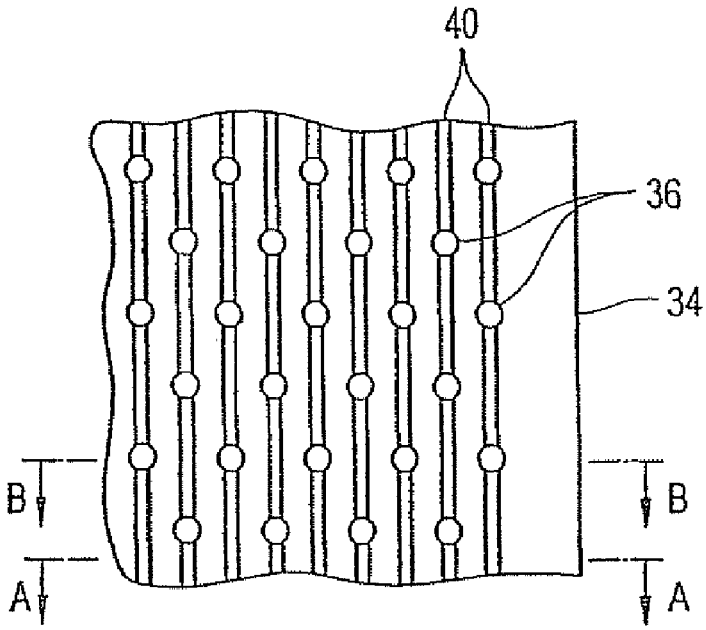
FIG. 3 is a view of an opposite side of the permeable belt of FIG. 2.
Figure 4:
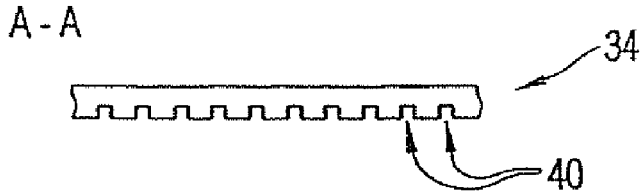
FIG. 4 is cross-section view of the permeable belt of FIGS. 2 and 3.
Figure 5:
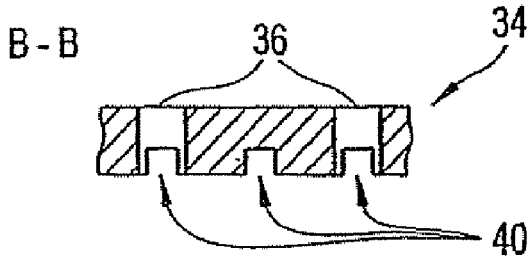
FIG. 5 is an enlarged cross-sectional view of the permeable belt of FIGS. 2-4.

With reference to FIGS. 2-5, there is shown details of one embodiment of the permeable belt 34 of belt press 22. The belt 34 includes a plurality of through holes or through openings 36. The holes 36 are arranged in a hole pattern 38, of which FIG. 2 illustrates one non-limiting example thereof. As illustrated in FIGS. 3-5, the belt 34 includes grooves 40 arranged on one side of belt 34, i.e., the outside of the belt 34 or the side which contacts the fabric 14. The permeable belt 34 is routed so as to engage an upper surface of the fabric 14 and thereby acts to press the fabric 14 against web 12 in the belt press 22. This, in turn, causes web 12 to be pressed against the fabric 20, which is supported thereunder by the vacuum roll 18. As this temporary coupling or pressing engagement continues around the vacuum roll 18 in the machine direction M, it encounters a vacuum zone Z. The vacuum zone Z receives air flow from the hood 24, which means that air passes from the hood 24, through the permeable belt 34, through the fabric 14, and through drying web 12 and finally through the belt 20 and into the zone Z. In this way, moisture is picked up from the web 12 and is transferred through the fabric 20 and through a porous surface of vacuum roll 18. As a result, the web 12 experiences or is subjected to both pressing and airflow in a simultaneous manner. Moisture drawn or directed into vacuum roll 18 mainly exits by way of a vacuum system (not shown). Some of the moisture from the surface of roll 18, however, is captured by one or more savealls 32 which are located beneath vacuum roll 18. As web 12 leaves the belt press 22, the fabric 20 is separated from the web 12, and the web 12 continues with the fabric 14 past vacuum pick up device 26. The device 26 additionally suctions moisture from the fabric 14 and the web 12 so as to stabilize the web 12.

The fabric 20 proceeds past one or more shower units 30. These units 30 apply moisture to the fabric 20 in order to clean the fabric 20. The fabric 20 then proceeds past a Uhle box 28, which removes moisture from fabric 20.

The fabric 14 can be a structured fabric 14, i.e., it can have a three dimensional structure that is reflected in web 12, whereby thicker pillow areas of the web 12 are formed. The structured fabric 14 may have, e.g., approximately 44 mesh, between approximately 30 mesh and approximately 50 mesh for towel paper, and between approximately 50 mesh and approximately 70 mesh for toilet paper. These pillow areas are protected during pressing in the belt press 22 because they are within the body of the structured fabric 14. As such, the pressing imparted by belt press assembly 22 upon the web 12 does not negatively impact web or sheet quality. At the same time, it increases the dewatering rate of vacuum roll 18. If the belt 34 is used in a No Press/Low Press apparatus, the pressure can be transmitted through a dewatering fabric, also known as a press fabric. In this case, the web 12 is not protected with a structured fabric 14. However, the use of the belt 34 is still advantageous because the press nip is much longer than a conventional press, which results in a lower specific pressure and less or reduced sheet compaction of the web 12.

The permeable belt 34 shown in FIGS. 2-5 can be made of metal, stainless steel and/or a polymeric material (or a combination of these materials), and can provide a low level of pressing in the range of between approximately 30 KPa and approximately 150 KPa, and preferably greater than approximately 70 KPa. Thus, if the suction roll 18 has a diameter of approximately 1.2 meter, the fabric tension for belt 34 can be greater than approximately 30 KN/m, and preferably greater than approximately 50 KN/m. The pressing length of permeable belt 34 against the fabric 14, which is indirectly supported by vacuum roll 18, can be at least as long as, or longer than, the circumferential length of the suction zone Z of roll 18. Of course, the invention also contemplates that the contact portion of permeable belt 34 (i.e., the portion of belt which is guided by or over the roll 18) can be shorter than suction zone Z.

Figure 5A:
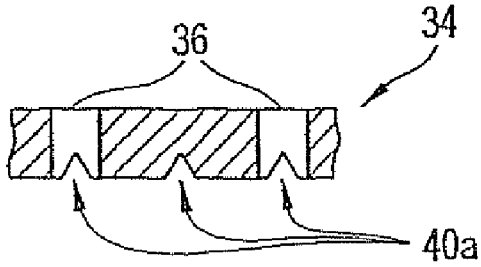
FIG. 5*a* is an enlarged cross-sectional view of the permeable belt of FIGS. 2-4 and illustrating optional triangular grooves.
Figure 5B:
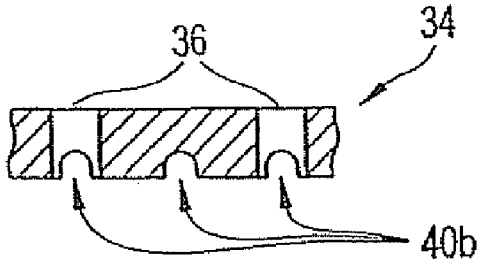
FIG. 5*b* is an enlarged cross-sectional view of the permeable belt of FIGS. 2-4 and illustrating optional semi-circular grooves.
Figure 5C:
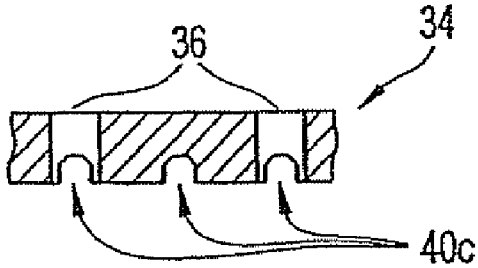
FIG. 5*c* is an enlarged cross-sectional view of the permeable belt of FIGS. 2-4 illustrating optional trapezoidal grooves.

As is shown in FIGS. 2-5, the permeable belt 34 has a pattern 38 of through holes 36, which may, for example, be formed by drilling, laser cutting, etched formed, or woven therein. The permeable belt 34 may also be essentially monoplaner, i.e., formed without the grooves 40 shown in FIGS. 3-5. The surface of the belt 34 which has the grooves 40 can be placed in contact with the fabric 14 along a portion of the travel of permeable belt 34 in a belt press 22. Each groove 40 connects with a set or row of holes 36 so as to allow the passage and distribution of air in the belt 34. Air is thus distributed along grooves 40. The grooves 40 and openings 36 thus constitute open areas of the belt 34 and are arranged adjacent to contact areas, i.e., areas where the surface of belt 34 applies pressure against the fabric 14 or the web 12. Air enters the permeable belt 34 through the holes 36 from a side opposite that of the side containing the grooves 40, and then migrates into and along the grooves 40 and also passes through the fabric 14, the web 12 and the fabric 20. As can be seen in FIG. 3, the diameter of holes 36 is larger than the width of the grooves 40. While circular holes 36 are preferred, they need not be circular and can have any shape or configuration which performs the intended function. Moreover, although the grooves 40 are shown in FIG. 5 as having a generally rectangular cross-section, the grooves 40 may have a different cross-sectional contour, such as, e.g., a triangular cross-section as shown in FIG. 5*a*, a trapezoidal cross-section as shown in FIG. 5*c*, and a semicircular or semi-elliptical cross-section as shown in FIG. 5*b*. The combination of the permeable belt 34 and the vacuum roll 18, is a combination that has been shown to increase sheet solids level by at least approximately 15%.

By way of non-limiting example, the width of the generally parallel grooves 40 shown in FIG. 3 can be approximately 2.5 mm and the depth of the grooves 40 measured from the outside surface (i.e.., the surface contacting belt 14) can be approximately 2.5 mm. The diameter of the through openings 36 can be approximately 4 mm. The distance, measured (of course) in the width direction, between the grooves 40 can be approximately 5 mm. The longitudinal distance (measured from the center-lines) between the openings 36 can be approximately 6.5 mm. The distance (measured from the center-lines in a direction of the width) between the openings 36, rows of openings, or grooves 40 can be approximately 7.5 mm. The openings 36 in every other row of openings can be offset by approximately half so that the longitudinal distance between adjacent openings can be half the distance between openings 36 of the same row, e.g., half of 6.5 mm. The overall width of the belt 34 can be approximately 160 mm more than the paper width and the overall length of the endlessly circulating belt 34 can be approximately 20 m. The tension limits of the belt 34 can be between, e.g., approximately 30 KN/m and approximately 50 KN/m.

FIGS. 6-11 show other non-limiting embodiments of the permeable belt 34 which can be used in a belt press 22 of the type shown in FIG. 1. The belt 34 shown FIGS. 6-9 may be an extended nip press belt made of a flexible reinforced polyurethane 42. It may also be a spiral link fabric 48 of the type shown in FIGS. 10 and 11. The permeable belt 34 may also be a spiral link fabric of the type described in GB 2 141 749A, the disclosure of which is hereby expressly incorporated by reference in its entirety. The permeable belt 34 shown in FIGS. 6-9 also provides a low level of pressing in the range of between approximately 30 KPa and approximately 150 KPa, and preferably greater than approximately 70 KPa. This allows, for example, a suction roll with a 1.2 meter diameter to provide a fabric tension of greater than approximately 30 KN/m, and preferably greater than approximately 50 KN/m, it can also be greater than approximately 60 KN/m, and also greater than approximately 80 KN/m. The pressing length of the permeable belt 34 against the fabric 14, which is indirectly supported by vacuum roll 18, can be at least as long as or longer than suction zone Z in roll 18. Of course, the invention also contemplates that the contact portion of permeable belt 34 can be shorter than suction zone Z.

Figure 6:
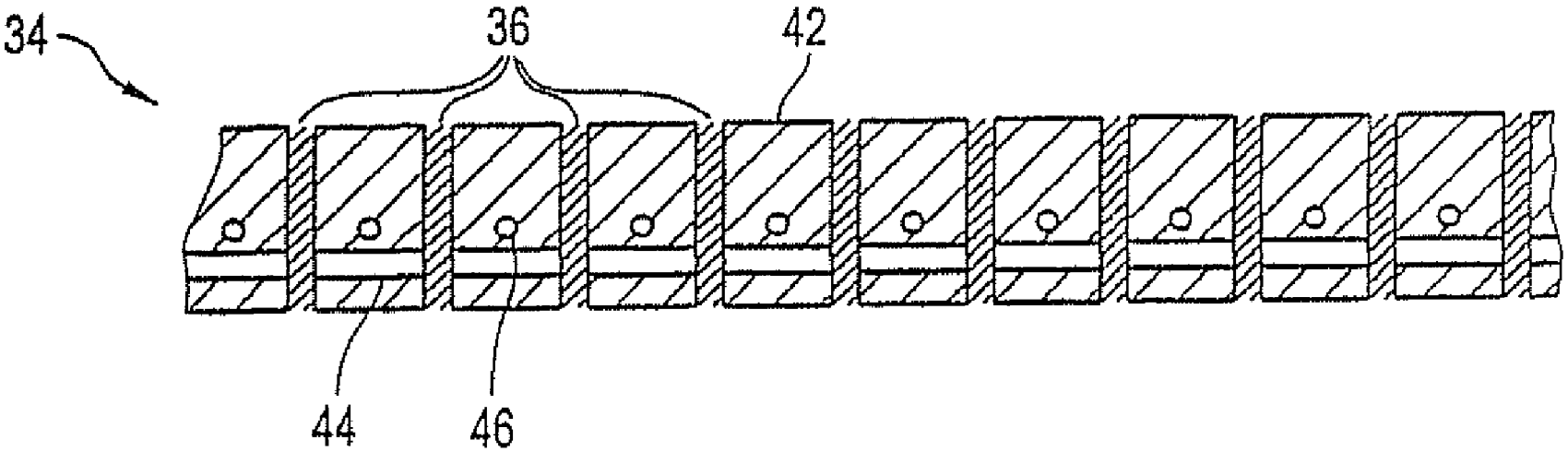
FIG. 6 is a cross-sectional view of the permeable belt of FIG. 3 along section line B-B.
Figure 7:
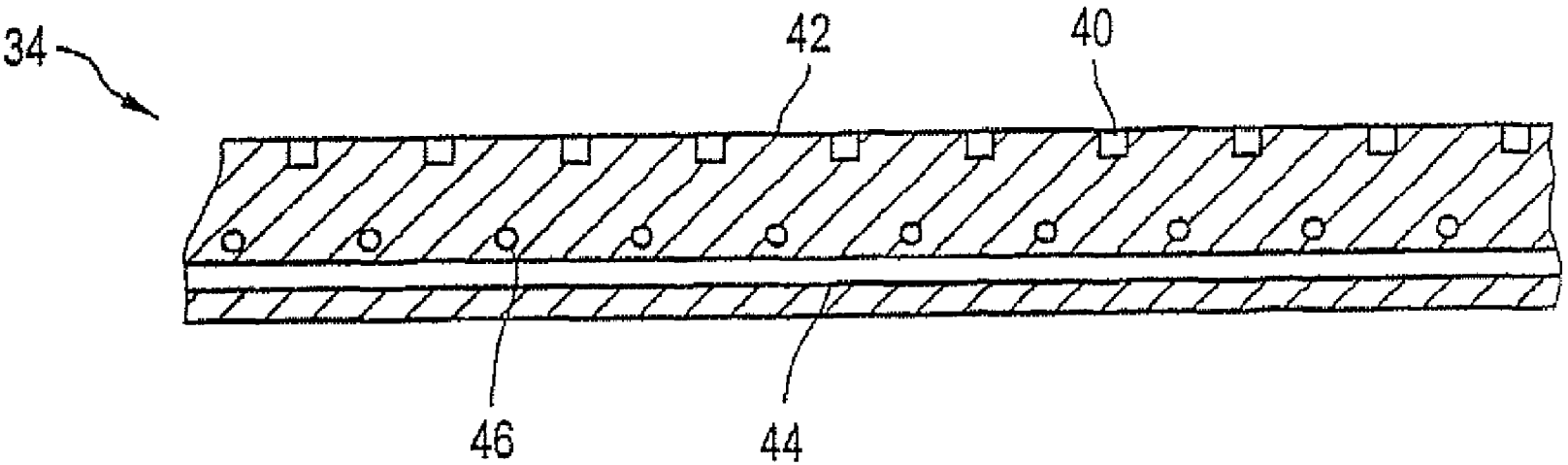
FIG. 7 is a cross-sectional view of the permeable belt of FIG. 3 along section line A-A.

With reference to FIGS. 6 and 7, the belt 34 can have the form of a polyurethane matrix 42 which has a permeable structure. The permeable structure can have the form of a woven structure with reinforcing machine direction yams 44 and cross direction yarns 46 at least partially embedded within polyurethane matrix 42. The belt 34 also includes through holes 36 and generally parallel longitudinal grooves 40 which connect the rows of openings as in the embodiment shown in FIGS. 3-5.

Figure 8:
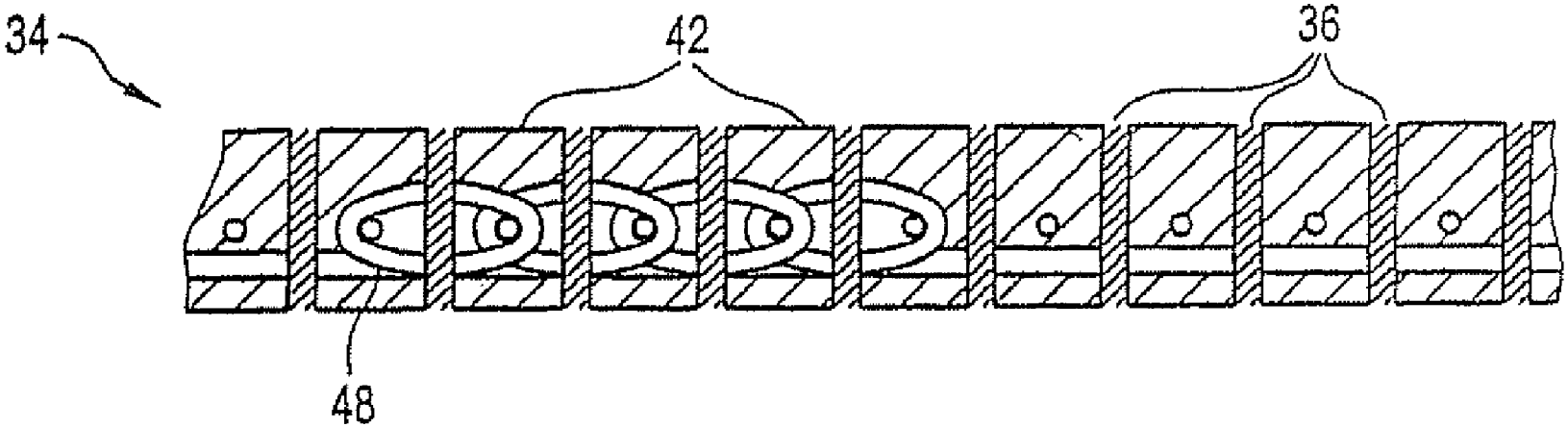
FIG. 8 is a cross-sectional view of another embodiment of the permeable belt of FIG. 3 along section line B-B.
Figure 9:
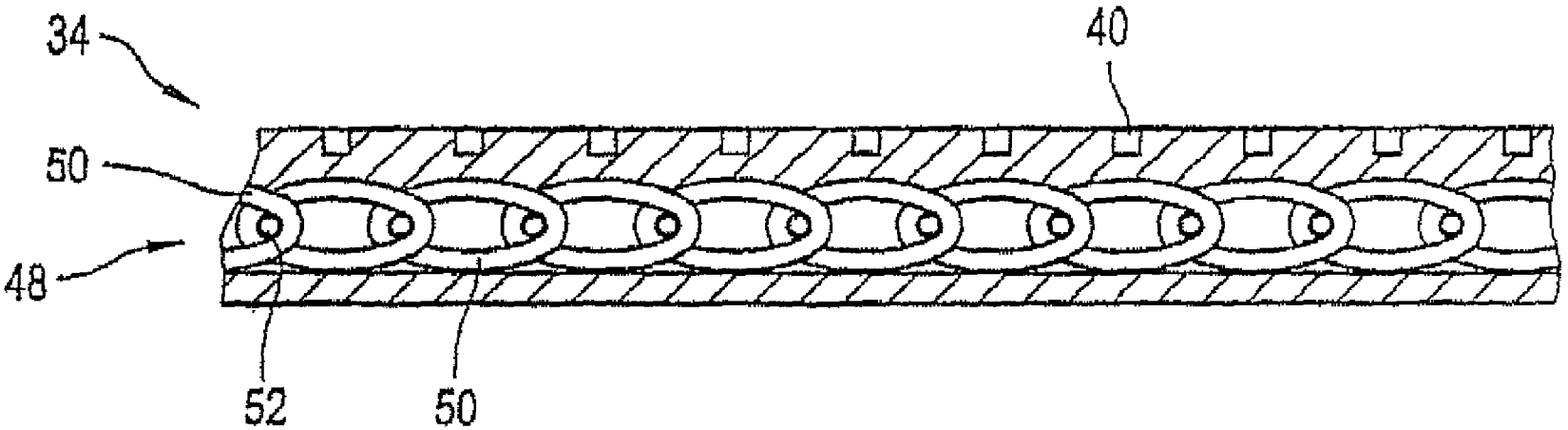
FIG. 9 is a cross-sectional view of another embodiment of the permeable belt of FIG. 3 along section line A-A.

FIGS. 8 and 9 illustrate still another embodiment for the belt 34. The belt 34 includes a polyurethane matrix 42 which has a permeable structure in the form of a spiral link fabric 48. The link fabric 48 is at least partially embedded within polyurethane matrix 42. Holes 36 extend through belt 34 and may at least partially sever portions of spiral link fabric 48. Generally parallel longitudinal grooves 40 also connect the rows of openings and in the above-noted embodiments. The spiral link fabric 34 described in this specification can also be made of a polymeric material and/or is preferably tensioned in the range of between approximately 30 KN/m and 80 KN/m, and preferably between approximately 35 KN/m and approximately 50 KN/m. This provides improved runnability of the belt, which is not able to withstand high tensions, and is balanced with sufficient dewatering of the paper web.

By way of non-limiting example, and with reference to the embodiments shown in FIGS. 6-9, the width of the generally parallel grooves 40 shown in FIG. 7 can be approximately 2.5 mm and the depth of the grooves 40 measured from the outside surface (i.e., the surface contacting belt 14) can be approximately 2.5 mm. The diameter of the through openings 36 can be approximately 4 mm. The distance, measured (of course) in the width direction, between the grooves 40 can be approximately 5 mm. The longitudinal distance (measured from the center-lines) between the openings 36 can be approximately 6.5 mm. The distance (measured from the center-lines in a direction of the width) between the openings 36, rows of openings, or grooves 40 can be approximately 7.5 mm. The openings 36 in every other row of openings can be offset by approximately half so that the longitudinal distance between adjacent openings can be half the distance between openings 36 of the same row, e.g., half of 6.5 mm. The overall width of the belt 34 can be approximately 160 mm more than the paper width and the overall length of the endlessly circulating belt 34 can be approximately 20 m.

Figure 10:
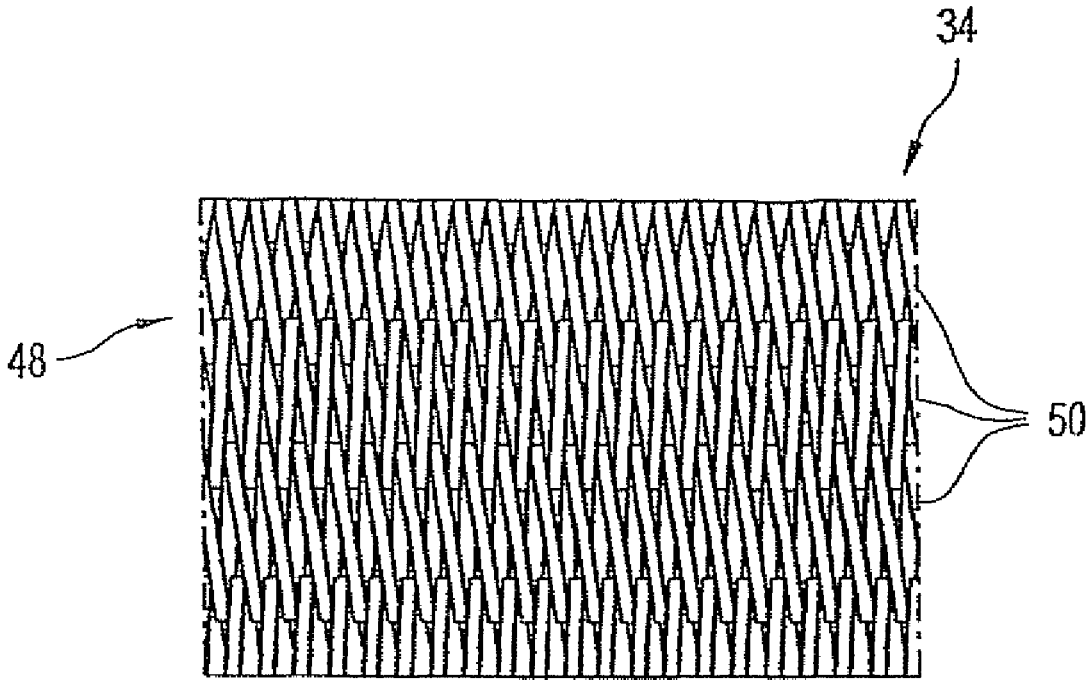
FIG. 10 is a surface view of another embodiment of the permeable belt of the present invention.
Figure 11:
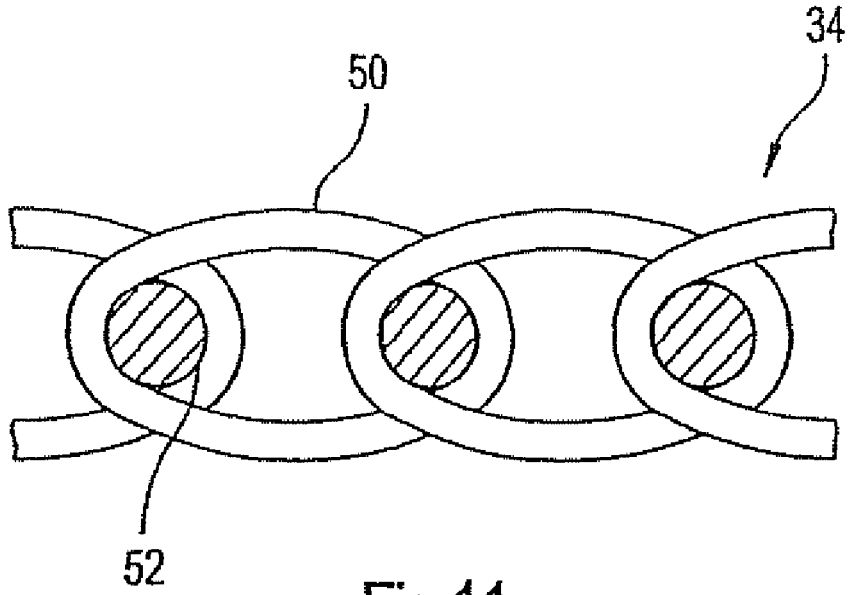
FIG. 11 is a side view of a portion of the permeable belt of FIG. 10.
Figure 23A:
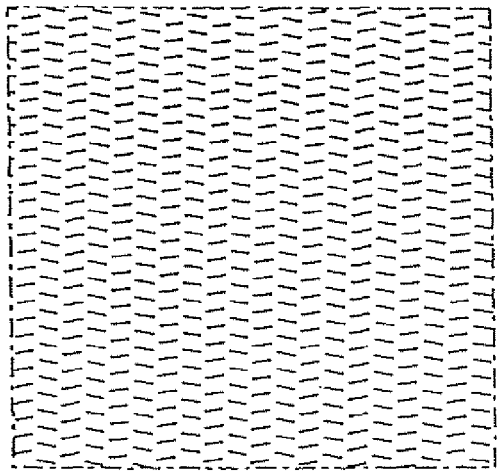
FIG. 23*a* illustrates an area of an Ashworth metal belt which can be used in the invention. The portions of the belt which are shown in black represent the contact area whereas the portions of the belt shown in white represent the non-contact area.
Figure 23B:
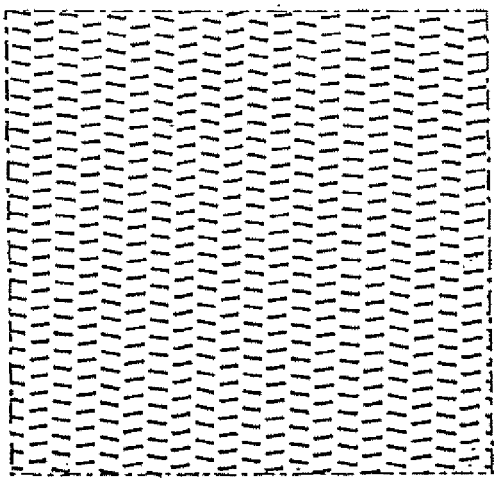
FIG. 23*b* illustrates an area of a Cambridge metal belt which can be used in the invention. The portions of the belt which are shown in black represent the contact area whereas the portions of the belt shown in white represent the non-contact area.
Figure 23C:
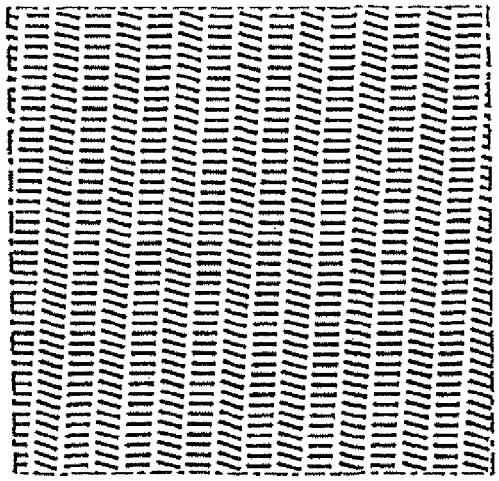
FIG. 23*c* illustrates an area of a Voith Fabrics link fabric which can be used in the invention. The portions of the belt which are shown in black represent the contact area whereas the portions of the belt shown in white represent the non-contact area.

FIGS. 10 and 11 shows yet another embodiment of the permeable belt 34. In this embodiment, yarns 50 are interlinked by entwining generally spiral woven yarns 50 with cross yams 52 in order to form link fabric 48. Non-limiting examples of this belt can include a Ashworth Metal Belt, a Cambridge Metal belt and a Voith Fabrics Link Fabric and are shown in FIGS. 23*a-c*. The spiral link fabric described in this specification can also be made of a polymeric material and/or is preferably tensioned in the range of between approximately 30 KN/m and 80 KN/m, and preferably between approximately 35 KN/m and approximately 50 KN/m. This provides improved runnability of the belt 34, which is not able to withstand high tensions, and is balanced with sufficient dewatering of the paper web. FIG. 23*a* illustrates an area of the Ashworth metal belt which is acceptable for use in the invention. The portions of the belt which are shown in black represent the contact area whereas the portions of the belt shown in white represent the non-contact area. The Ashworth belt is a metal link belt which is tensioned at approximately 60 KN/m. The open area may be between approximately 75% and approximately 85%. The contact area may be between approximately 15% and approximately 25%. FIG. 23*b* illustrates an area of a Cambridge metal belt which is preferred for use in the invention. Again, the portions of the belt which are shown in black represent the contact area whereas the portions of the belt shown in white represent the non-contact area. The Cambridge belt is a metal link belt which is tensioned at approximately 50 KN/m. The open area may be between approximately 68% and approximately 76%. The contact area may be between approximately 24% and approximately 32%. Finally, FIG. 23*c* illustrates an area of a Voith Fabrics link fabric which is most preferably used in the invention. The portions of the belt which are shown in black represent the contact area whereas the portions of the belt shown in white represent the non-contact area. The Voith Fabrics belt may be a polymer link fabric which is tensioned at approximately 40 KN/m. The open area may be between approximately 51% and approximately 62%. The contact area may be between approximately 38% and approximately 49%.

As with the previous embodiments, the permeable belt 34 shown in FIGS. 10 and 11 is capable of running at high running tensions of between at least approximately 30 KN/m and at least approximately 50 KN/m or higher and may have a surface contact area of approximately 10% or greater, as well as an open area of approximately 15% or greater. The open area may be approximately 25% or greater. The composition of permeable belt 34 shown in FIGS. 10 and 11 may include a thin spiral link structure having a support layer within permeable belt 34. The spiral link fabric can be made of metal and/or stainless steel. Further, permeable belt 34 may be a spiral link fabric 34 having a contact area of between approximately 15% and approximately 55%, and an open area of between approximately 45% to approximately 85%. More preferably, the spiral link fabric 34 may have an open area of between approximately 50% and approximately 65%, and a contact area of between approximately 35% and approximately 50%.

The process of using the advanced dewatering system (ADS) 10 shown in FIG. 1 will now be described. The ADS 10 utilizes belt press 22 to remove water from web 12 after the web is initially formed prior to reaching belt press 22. A permeable belt 34 is routed in the belt press 22 so as to engage a surface of fabric 14 and thereby press fabric 14 further against web 12, thus pressing the web 12 against fabric 20, which is supported thereunder by a vacuum roll 18. The physical pressure applied by the belt 34 places some hydraulic pressure on the water in web 12 causing it to migrate toward fabrics 14 and 20. As this coupling of web 12 with fabrics 14 and 20, and belt 34 continues around vacuum roll 18, in machine direction M, it encounters a vacuum zone Z through which air is passed from a hood 24, through the permeable belt 34, through the fabric 14, so as to subject the web 12 to drying. The moisture picked up by the air flow from the web 12 proceeds further through fabric 20 and through a porous surface of vacuum roll 18. In the permeable belt 34, the drying air from the hood 24 passes through holes 36, is distributed along grooves 40 before passing through the fabric 14. As web 12 leaves belt press 22, the belt 34 separates from the fabric 14. Shortly thereafter, the fabric 20 separates from web 12, and the web 12 continues with the fabric 14 past vacuum pick up unit 26, which additionally suctions moisture from the fabric 14 and the web 12.

The permeable belt 34 of the present invention is capable of applying a line force over an extremely long nip, i.e., 10 times longer than for a shoe press, thereby ensuring a long dwell time in which pressure is applied against web 12 as compared to a standard shoe press. This results in a much lower specific pressure, i.e., 20 times lower than for a shoe press, thereby reducing the sheet compaction and enhancing sheet quality. The present invention further allows for a simultaneous vacuum and pressing dewatering with airflow through the web at the nip itself.

Figure 12:
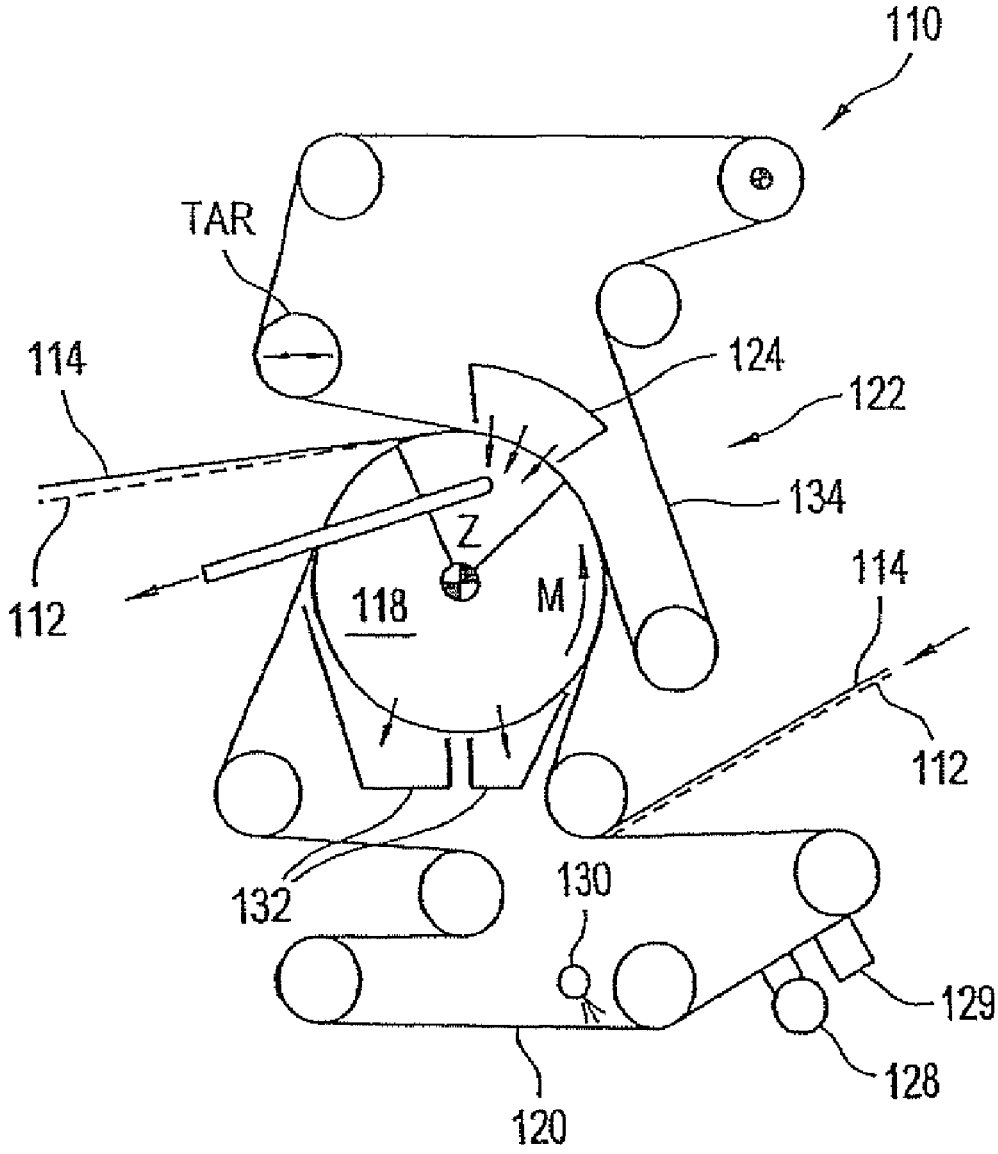
FIG. 12 is a cross-sectional schematic diagram of still another advanced dewatering system with an embodiment of a belt press according to the present invention.

FIG. 12 shows another an advanced dewatering system 110 for processing a fibrous web 112. The system 110 includes an upper fabric 114, a vacuum roll 118, a dewatering fabric 120, a belt press assembly 122, a hood 124 (which may be a hot air hood), a Uhle box 128, one or more shower units 130, one or more savealls 132, one or more heater units 129. The fibrous material web 112 enters system 110 generally from the right as shown in FIG. 12. The fibrous web 112 is a previously formed web (i.e., previously formed by a mechanism not shown) which is placed on the fabric 114. As was the case in FIG. 1, a suction device (not shown but similar to device 16 in FIG. 1) can provide suctioning to one side of the web 112, while the suction roll 118 provides suctioning to an opposite side of the web 112.

The fibrous web 112 is moved by fabric 114 in a machine direction M past one or more guide rolls. Although it may not be necessary, before reaching the suction roll, the web 112 may have sufficient moisture is removed from web 112 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 112 proceeds along the machine direction M, it comes into contact with a dewatering fabric 120. The dewatering fabric 120 can be an endless circulating belt which is guided by a plurality of guide rolls and is also guided around a suction roll 118. The web 112 then proceeds toward vacuum roll 118 between the fabric 114 and the dewatering fabric 120. The vacuum roll 118 can be a driven roll which rotates along the machine direction M and is operated at a vacuum level of between approximately −0.2 to approximately −0.8 bar with a preferred operating level of at least approximately −0.4 bar. By way of non-limiting example, the thickness of the vacuum roll shell of roll 118 may be in the range of between 25 mm and 75 mm. The mean airflow through the web 112 in the area of the suction zone Z can be approximately 150 $m^3$/min per meter machine width. The fabric 114, web 112 and dewatering fabric 120 is guided through a belt press 122 formed by the vacuum roll 118 and a permeable belt 134. As is shown in FIG. 12, the permeable belt 134 is a single endlessly circulating belt which is guided by a plurality of guide rolls and which presses against the vacuum roll 118 so as to form the belt press 122. To control and/or adjust the tension of the belt 134, a tension adjusting roll TAR is provided as one of the guide rolls.

The circumferential length of vacuum zone Z can be between approximately 200 mm and approximately 2500 mm, and is preferably between approximately 800 mm and approximately 1800 mm, and an even more preferably between approximately 1200 mm and approximately 1600 mm. The solids leaving vacuum roll 118 in web 112 will vary between approximately 25% and approximately 55% depending on the vacuum pressures and the tension on permeable belt as well as the length of vacuum zone Z and the dwell time of web 112 in vacuum zone Z. The dwell time of web 112 in vacuum zone Z is sufficient to result in this solids range of between approximately 25% to approximately 55%.

The press system shown in FIG. 12 thus utilizes at least one upper or first permeable belt or fabric 114, at least one lower or second belt or fabric 120 and a paper web 112 disposed therebetween, thereby forming a package which can be led through the belt press 122 formed by the roll 118 and the permeable belt 134. A first surface of a pressure producing element 134 is in contact with the at least one upper fabric 114. A second surface of a supporting structure 118 is in contact with the at least one lower fabric 120 and is permeable. A differential pressure field is provided between the first and the second surfaces, acting on the package of at least one upper and at least one lower fabric and the paper web therebetween. In this system, a mechanical pressure is produced on the package and therefore on the paper web 112. This mechanical pressure produces a predetermined hydraulic pressure in the web 112, whereby the contained water is drained. The upper fabric 114 has a bigger roughness and/or compressibility than the lower fabric 120. An airflow is caused in the direction from the at least one upper 114 to the at least one lower fabric 120 through the package of at least one upper fabric 114, at least one lower fabric 120 and the paper web 112 therebetween.

The upper fabric 114 can be permeable and/or a so-called "structured fabric". By way of non-limiting examples, the upper fabric 114 can be e.g., a TAD fabric. The hood 124 can also be replaced with a steam box which has a sectional construction or design in order to influence the moisture or dryness cross-profile of the web.

Figure 13:
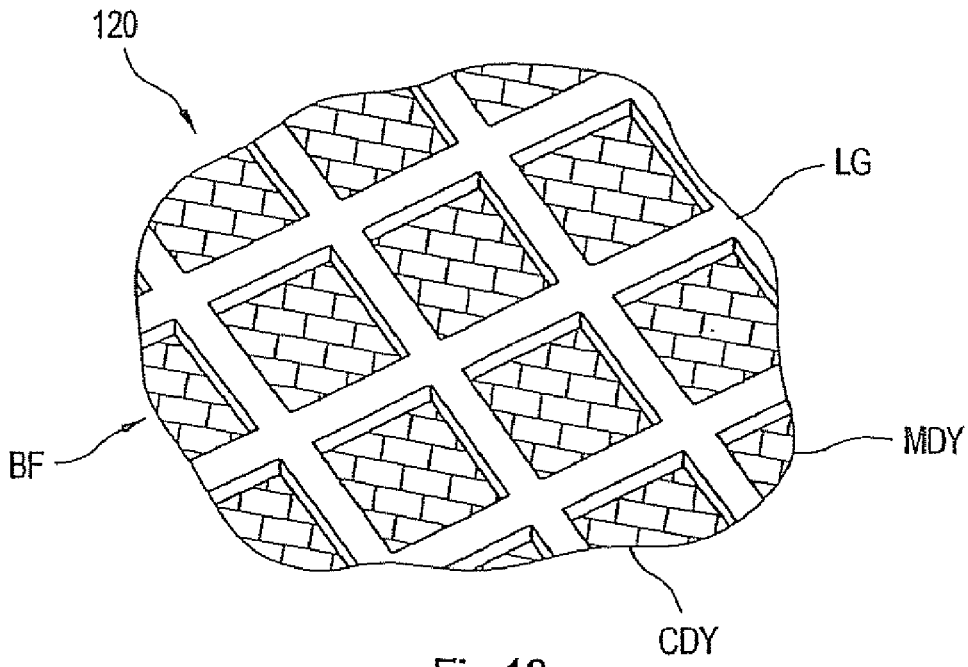
FIG. 13 is an enlarged partial view of one dewatering fabric which can be used on the advanced dewatering systems of the present invention.

With reference to FIG. 13, the lowerfabric 120 can be a membrane or fabric which includes a permeable base fabric BF and a lattice grid LG attached thereto and which is made of polymer such as polyurethane. The lattice grid LG side of the fabric 120 can be in contact with the suction roll 118 while the opposite side contacts the paper web 112. The lattice grid LG may be attached or arranged on the base fabric BF by utilizing various known procedures, such as, for example, an extrusion technique or a screen printing technique. As shown in FIG. 13, the lattice grid LG can also be oriented at an angle relative to machine direction yarns MDY and cross-direction yarns CDY. Although this orientation is such that no part of the lattice grid LG is aligned with the machine direction yarns MDY, other orientations such as that shown in FIG. 14 can also be utilized. Although the lattice grid LG is shown as a rather uniform grid pattern, this pattern can also be discontinuous and/or non-symmetrical at least in part. Further, the material between the interconnections of the lattice structure may take a circuitous path rather than being substantially straight, as is shown in FIG. 13. Lattice grid LG can also be made of a synthetic, such as a polymer or specifically a polyurethane, which attaches itself to the base fabric BF by its natural adhesion properties. Making the lattice grid LG of a polyurethane provides it with good frictional properties, such that it seats well against the vacuum roll 118. This, then forces vertical airflow and eliminates any "x, y plane" leakage. The velocity of the air is sufficient to prevent any re-wetting once the water makes it through the lattice grid LG. Additionally, the lattice grid LG may be a thin perforated hydrophobic film having an air permeability of approximately 35 cfm or less, preferably approximately 25 cfm. The pores or openings of the lattice grid LG can be approximately 15 microns. The lattice grid LG can thus provide good vertical airflow at high velocity so as to prevent rewet. With such a fabric 120, it is possible to form or create a surface structure that is independent of the weave patterns.

Figure 14:
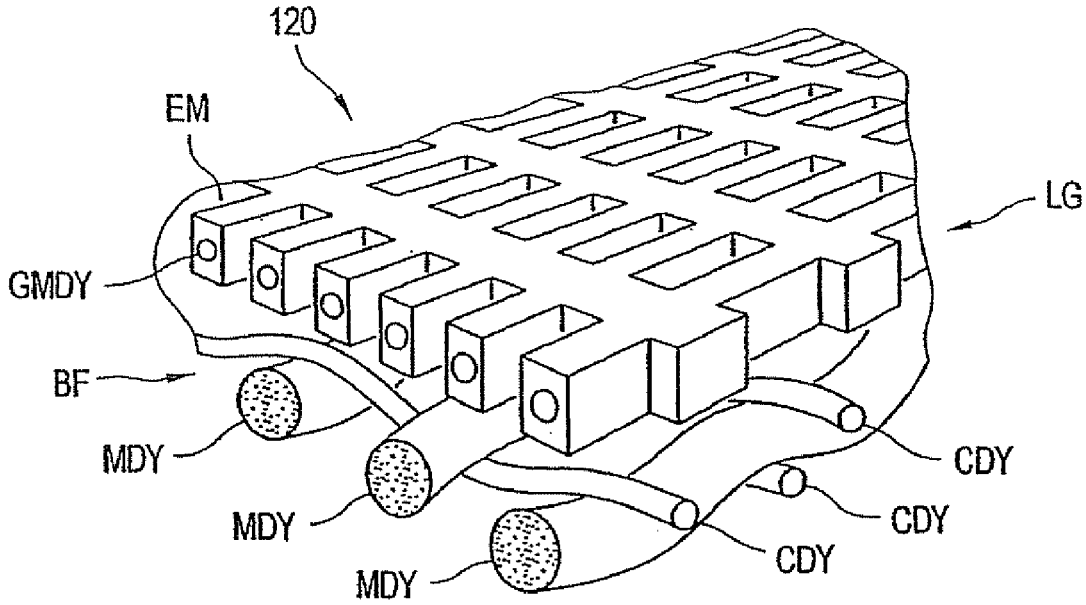
FIG. 14 is an enlarged partial view of another dewatering fabric which can be used on the advanced dewatering systems of the present invention.

With reference to FIG. 14, it can be seen that the lower dewatering fabric 120 can have a side which contacts the vacuum roll 118 which also includes a permeable base fabric BF and a lattice grid LG. The base fabric BF includes machine direction multifilament yarns MDY (which could also be mono or twisted mono yarns or combinations of multifil and monofil twisted and untwisted yarns from equal or different polymeric materials) and cross-direction multifilament yarns CDY (which could also be mono or twisted mono yarns or combinations of multifil and monofil twisted and untwisted yarns from equal or different polymeric materials) and is adhered to the lattice grid LG, so as to form a so called "anti-rewet layer". The lattice grid can be made of a composite material, such as an elastomeric material, which may be the same as the as the lattice grid described in FIG. 13. As can be seen in FIG. 14, the lattice grid LG can itself include machine direction yarns GMDY with an elastomeric material EM being formed around these yarns. The lattice grid LG may thus be composite grid mat formed on elastomeric material EM and machine direction yarns GMDY. In this regard, the grid machine direction yarns GMDY may be pre-coated with elastomeric material EM before being placed in rows that are substantially parallel in a mold that is used to reheat the elastomeric material EM causing it to re-flow into the pattern shown as grid LG in FIG. 14. Additional elastomeric material EM may be put into the mold as well. The grid structure LG, as forming the composite layer, in then connected to the base fabric BF by one of many techniques including the laminating of the grid LG to the permeable base fabric BF, melting the elastomeric coated yarn as it is held in position against the permeable base fabric BF or by re-melting the grid LG to the permeable base fabric BF. Additionally, an adhesive may be utilized to attach the grid LG to the permeable base fabric BF. The composite layer LG should be able to seal well against the vacuum roll 118 preventing "x,y plane" leakage and allowing vertical airflow to prevent rewet. With such a fabric, it is possible to form or create a surface structure that is independent of the weave patterns.

The belt 120 shown in FIGS. 13 and 14 can also be used in place of the belt 20 shown in the arrangement of FIG. 1.

Figure 15:
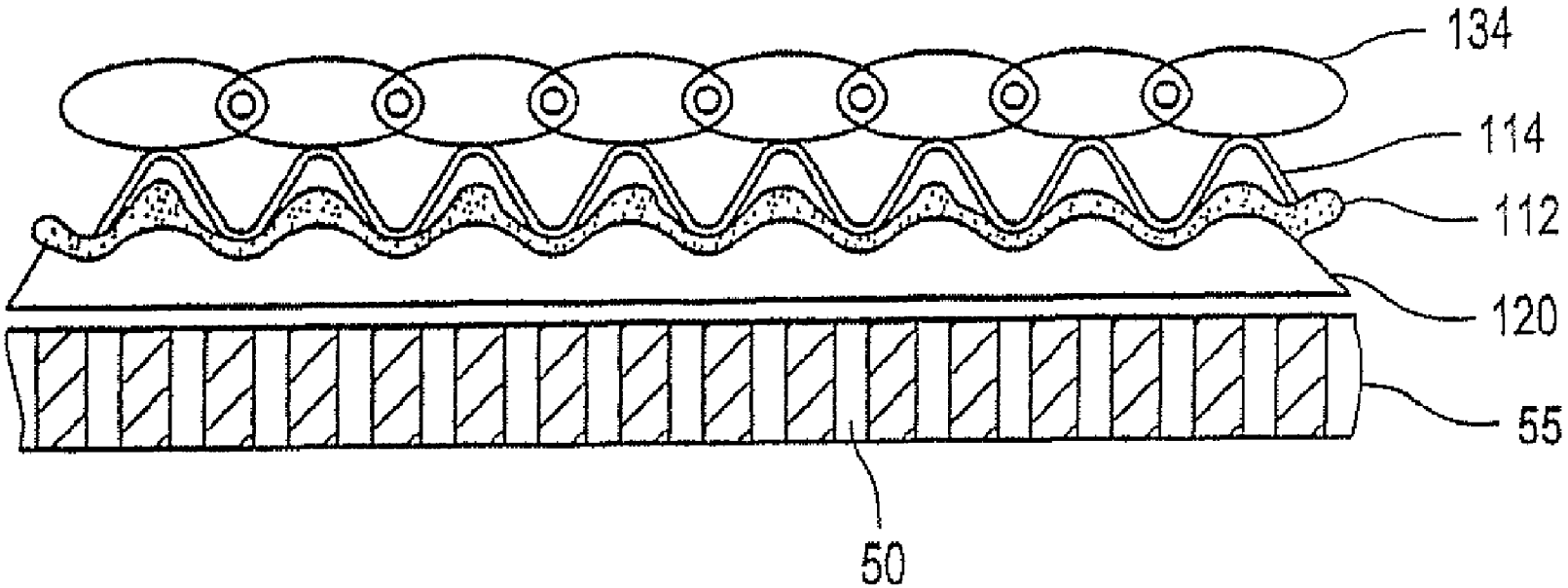
FIG. 15 is a exaggerated cross-sectional schematic diagram of one embodiment of a pressing portion of the advanced dewatering system according to the present invention.
Figure 16:
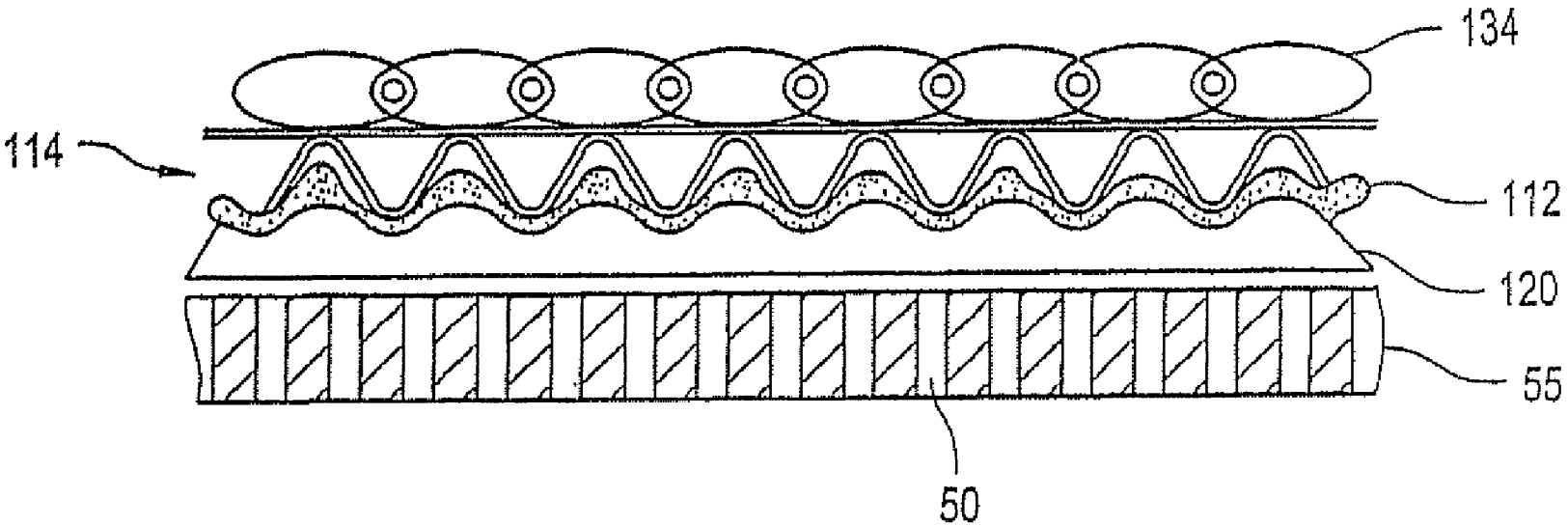
FIG. 16 is a exaggerated cross-sectional schematic diagram of another embodiment of a pressing portion of the advanced dewatering system according to the present invention.

FIG. 15 shows an enlargement of one possible arrangement in a press. A suction support surface SS acts to support the fabrics 120, 114, 134 and the web 112. The suction support surface SS has suction openings SO. The openings SO can preferably be chamfered at the inlet side in order to provide more suction air. The surface SS may be generally flat in the case of a suction arrangement which uses a suction box of the type shown in, e.g., FIG. 16. Preferably, the suction surface SS is a moving curved roll belt or jacket of the suction roll 118 in this case, the belt 134 can be a tensioned spiral link belt of the type already described herein. The belt 114 can be a structured fabric and the belt 120 can be a dewatering felt of the types described above. In this arrangement, moist air is drawn from above the belt 134 and through the belt 114, web 112, and belt 120 and finally through the openings SO and into the suction roll 118. Another possibility shown in FIG. 16 provides for the suction surface SS to be a moving curved roll belt or jacket of the suction roll 118 and the belt 114 to be a SPECTRA membrane. In this case, the belt 134 can be a tensioned spiral link belt of the type already described herein. The belt 120 can be a dewatering felt of the types described above. In this arrangement, also moist air is drawn from above the belt 134 and through the belt 114, web 112, and belt 120 and finally through the openings SO and into the suction roll 118.

Figure 17:
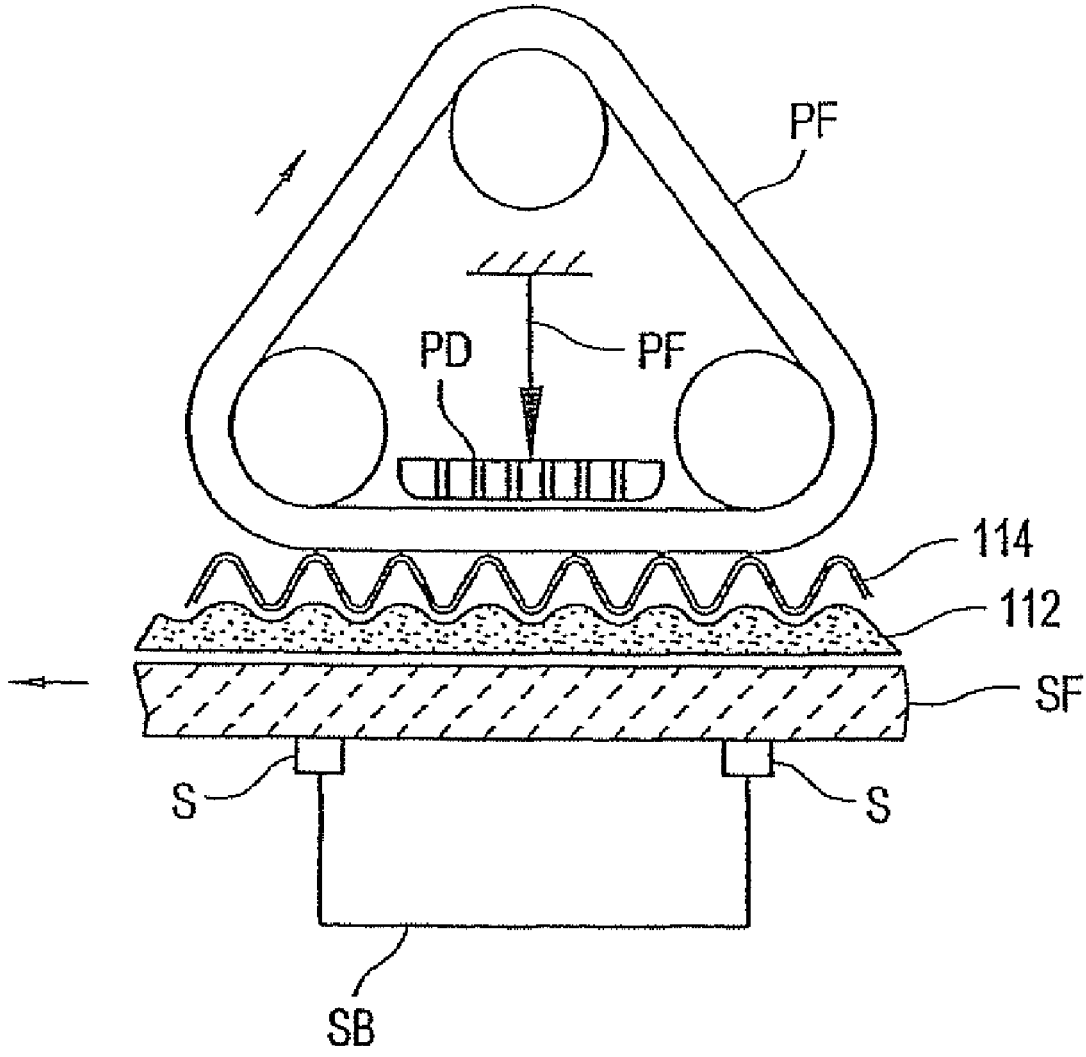
FIG. 17 is a cross-sectional schematic diagram of still another advanced dewatering system with another embodiment of a belt press according to the present invention.
Figure 18:
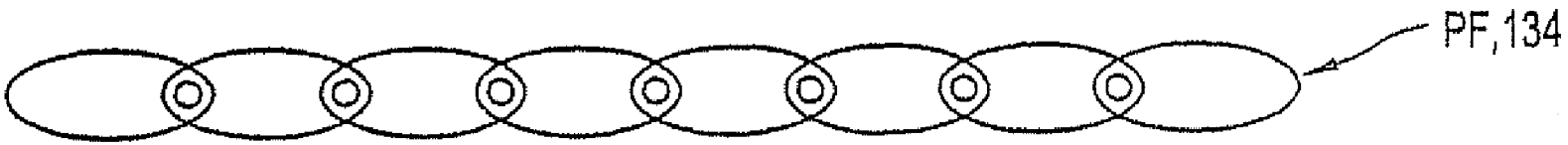
FIG. 18 is a partial side view of an optional permeable belt which may be used in the advanced dewatering systems of the present invention.
Figure 19:
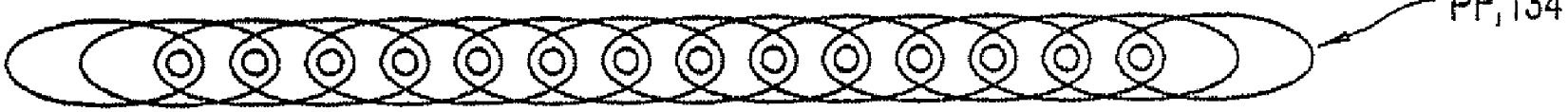
FIG. 19 is a partial side view of another optional permeable belt which may be used in the advanced dewatering systems of the present invention.

FIG. 17 illustrates another way in which the web 112 can be subjecting to drying. In this case, a permeable support fabric SF (which can be similar to fabrics 20 or 120) is moved over a suction box SB. The suction box SB is sealed with seals S to an underside surface of the belt SF. A support belt 114 has the form of a TAD fabric and carries the web 112 into the press formed by the belt PF, and pressing device PD arranged therein, and the support belt SF and stationary suction box SB. The circulating pressing belt PF can be a tensioned spiral link belt of the type already described herein and/or of the type shown in FIGS. 18 and 19. The belt PF can also alternatively be a groove belt and/or it can also be permeable. In this arrangement, the pressing device PD presses the belt PF with a pressing force PF against the belt SF while the suction box SB applies a vacuum to the belt SF, web 112 and belt 114. During pressing, moist air can be drawn from at least the belt 114, web 112 and belt SF and finally into the suction box SB.

The upper fabric 114 can thus transport the web 112 to and away from the press and/or pressing system. The web 112 can lie in the three-dimensional structure of the upper fabric 114, and therefore it is not flat, but instead has also a three-dimensional structure, which produces a high bulky web. The lower fabric 120 is also permeable. The design of the lower fabric 120 is made to be capable of storing water. The lower fabric 120 also has a smooth surface. The lower fabric 120 is preferably a felt with a belt layer. The diameter of the belt fibers of the lower fabric 120 can be equal to or less than approximately 11 dtex, and can preferably be equal to or lower than approximately 4.2 dtex, or more preferably be equal to or less than approximately 3.3 dtex. The batt fibers can also be a blend of fibers. The lower fabric 120 can also contain a vector layer which contains fibers from at least approximately 67 dtex, and can also contain even courser fibers such as, e.g., at least approximately 100 dtex, at least approximately 140 dtex, or even higher dtex numbers. This is important for the good absorption of water. The wetted surface of the batt layer of the lower fabric 120 and/or of the lower fabric 120 itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the lower fabric 120 should be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is important for the good absorption of water.

The compressibility (thickness change by force in mm/N) of the upper fabric 114 is lower than that of the lower fabric 120. This is important in order to maintain the three-dimensional structure of the web 112, i.e., to ensure that the upper belt 114 is a stiff structure.

The resilience of the lower fabric 120 should be considered. The density of the lower fabric 120 should be equal to or higher than approximately 0.4 $g/cm^3$, and is preferably equal to or higher than approximately 0.5 $g/cm^3$, and is ideally equal to or higher than approximately 0.53 g/cm$^3$. This can be advantageous at web speeds of greater than 1200 m/min. A reduced felt volume makes it easier to take the water away from the felt 120 by the air flow, i.e., to get the water through the felt 120. Therefore the dewatering effect is smaller. The permeability of the lower fabric 120 can be lower than approximately 80 cfm, preferably lower than 40 cfm, and ideally equal to or lower than 25 cfm. A reduced permeability makes it easier to take the water away from the felt 120 by the air flow, i.e., to get the water through the felt 120. As a result, the re-wetting effect is smaller. A too high permeability, however, would lead to a too high air flow, less vacuum level for a given vacuum pump, and less dewatering of the felt because of the too open structure.

Figure 20:
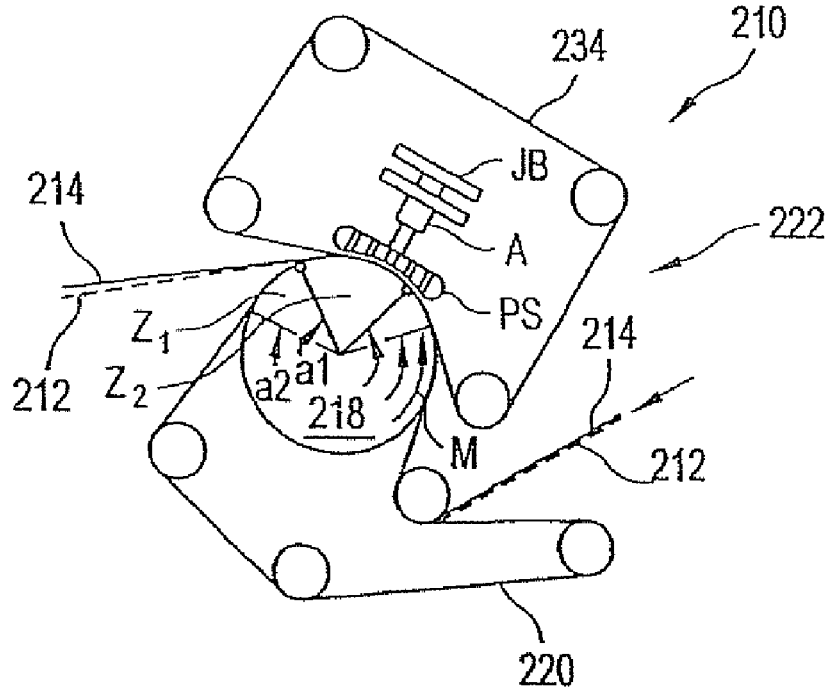
FIG. 20 is a cross-sectional schematic diagram of still another advanced dewatering system with an embodiment of a belt press which uses a pressing shoe according to the present invention.

The second surface of the supporting structure, i.e., the surface supporting the belt 120, can be flat and/or planar. In this regard, the second surface of the supporting structure SF can be formed by a flat suction box SB. The second surface of the supporting structure SF can also preferably be curved. For example, the second surface of the supporting structure SF can be formed or run over a suction roll 118 or cylinder whose diameter is, e.g., approximately 1 m. The suction device or cylinder 118 may comprise at least one suction zone Z. It may also comprise two suction zones Z1 and Z2 as is shown in FIG. 20. The suction cylinder 218 may also include at least one suction box with at least one suction arc. At least one mechanical pressure zone can be produced by at least one pressure field (i.e., by the tension of a belt) or through the first surface by, e.g., a press element. The first surface can be an impermeable belt 134, but with an open surface towards the first fabric 114, e.g., a grooved or a blind drilled and grooved open surface, so that air can flow from outside into the suction arc. The first surface can be a permeable belt 134. The belt may have an open area of at least approximately 25%, preferably greater than approximately 35%, most preferably greater than approximately 50%. The belt 134 may have a contact area of at least approximately 10%, at least approximately 25%, and preferably between approximately 50% and approximately 85% in order to have a good pressing contact.

FIG. 20 shows another an advanced dewatering system 210 for processing a fibrous web 212. The system 210 includes an upper fabric 214, a vacuum roll 218, a dewatering fabric 220 and a belt press assembly 222. Other optional features which are not shown include a hood (which may be a hot air hood or steam box), one or more Uhle boxes, one or more shower units, one or more savealls, and one or more heater units, as is shown in FIGS. 1 and 12. The fibrous material web 212 enters system 210 generally from the right as shown in FIG. 20. The fibrous web 212 is a previously formed web (i.e., previously formed by a mechanism not shown) which is placed on the fabric 214. As was the case in FIG. 1, a suction device (not shown but similar to device 16 in FIG. 1) can provide suctioning to one side of the web 212, while the suction roll 218 provides suctioning to an opposite side of the web 212.

The fibrous web 212 is moved by the fabric 214, which may be a TAD fabric, in a machine direction M past one or more guide rolls. Although it may not be necessary, before reaching the suction roll 218, the web 212 may have sufficient moisture is removed from web 212 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 212 proceeds along the machine direction M, it comes into contact with a dewatering fabric 220. The dewatering fabric 220 (which can be any type described herein) can be endless circulating belt which is guided by a plurality of guide rolls and is also guided around a suction roll 218. The web 212 then proceeds toward vacuum roll 218 between the fabric 214 and the dewatering fabric 220. The vacuum roll 218 can be a driven roll which rotates along the machine direction M and is operated at a vacuum level of between approximately −0.2 to approximately −0.8 bar with a preferred operating level of at least approximately −0.5 bar. By way of non-limiting example, the thickness of the vacuum roll shell of roll 218 may be in the range of between 25 mm and 75 mm. The mean airflow through the web 212 in the area of the suction zones Z1 and Z2 can be approximately 150 m$^3$/meter of machine width. The fabric 214, web 212 and dewatering fabric 220 are guided through a belt press 222 formed by the vacuum roll 218 and a permeable belt 234. As is shown in FIG. 20, the permeable belt 234 is a single endlessly circulating belt which is guided by a plurality of guide rolls and which presses against the vacuum roll 218 so as to form the belt press 122. To control and/or adjust the tension of the belt 234, one of the guide rolls may be a tension adjusting roll. This arrangement also includes a pressing device arranged within the belt 234. The pressing device includes a journal bearing JB, one or more actuators A, and one or more pressing shoes PS which are preferably perforated.

The circumferential length of at least vacuum zone Z2 can be between approximately 200 mm and approximately 2500 mm, and is preferably between approximately 800 mm and approximately 1800 mm, and an even more preferably between approximately 1200 mm and approximately 1600 mm. The solids leaving vacuum roll 218 in web 212 will vary between approximately 25% and approximately 55% depending on the vacuum pressures and the tension on permeable belt 234 and the pressure from the pressing device PS/A/JB as well as the length of vacuum zone Z2, and the dwell time of web 212 in vacuum zone Z2. The dwell time of web 212 in vacuum zone Z2 is sufficient to result in this solids range of approximately 25% and approximately 55%.

Figure 21:
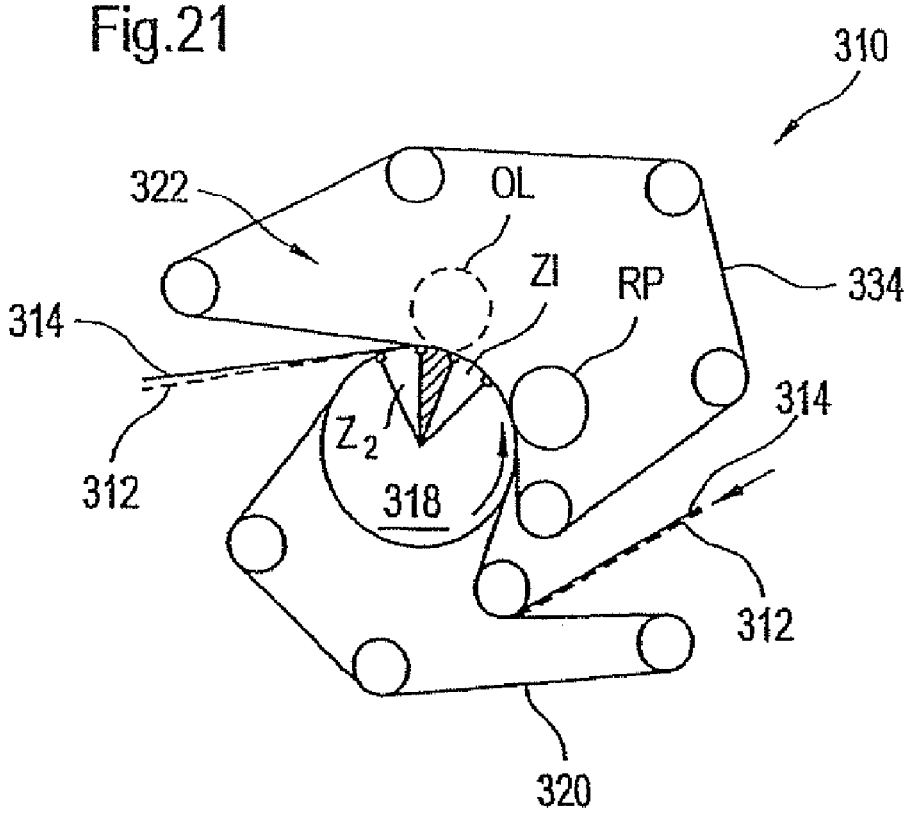
FIG. 21 is a cross-sectional schematic diagram of still another advanced dewatering system with an embodiment of a belt press which uses a press roll according to the present invention.

FIG. 21 shows another an advanced dewatering system 310 for processing a fibrous web 312. The system 310 includes an upper fabric 314, a vacuum roll 318, a dewatering fabric 320 and a belt press assembly 322. Other optional features which are not shown include a hood (which may be a hot air hood or steam box), one or more Uhle boxes, one or more shower units, one or more savealls, and one or more heater units, as is shown in FIGS. 1 and 12. The fibrous material web 312 enters system 310 generally from the right as shown in FIG. 21. The fibrous web 312 is a previously formed web (i.e., previously formed by a mechanism not shown) which is placed on the fabric 314. As was the case in FIG. 1, a suction device (not shown but similar to device 16 in FIG. 1) can provide suctioning to one side of the web 312, while the suction roll 318 provides suctioning to an opposite side of the web 312.

The fibrous web 312 is moved by fabric 314, which can be a TAD fabric, in a machine direction M past one or more guide rolls. Although it may not be necessary, before reaching the suction roll 318, the web 212 may have sufficient moisture is removed from web 212 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 312 proceeds along the machine direction M, it comes into contact with a dewatering fabric 320. The dewatering fabric 320 (which can be any type described herein) can be endless circulating belt which is guided by a plurality of guide rolls and is also guided around a suction roll 318. The web 312 then proceeds toward vacuum roll 318 between the fabric 314 and the dewatering fabric 320. The vacuum roll 318 can be a driven roll which rotates along the machine direction M and is operated at a vacuum level of between approximately −0.2 to approximately −0.8 bar with a preferred operating level of at least approximately −0.5 bar. By way of non-limiting example, the thickness of the vacuum roll shell of roll 318 may be in the range of between 25 mm and 75 mm. The mean airflow through the web 312 in the area of the suction zones Z1 and Z2 can be approximately 150 $m^3$/meter of machine width. The fabric 314, web 312 and dewatering fabric 320 are guided through a belt press 322 formed by the vacuum roll 318 and a permeable belt 334. As is shown in FIG. 21, the permeable belt 334 is a single endlessly circulating belt which is guided by a plurality of guide rolls and which presses against the vacuum roll 318 so as to form the belt press 322. To control and/or adjust the tension of the belt 334, one of the guide rolls may be a tension adjusting roll. This arrangement also includes a pressing roll RP arranged within the belt 334. The pressing device RP can be press roll and can be arranged either before the zone Z1 or between the two separated zones Z1 and Z2 at optional location OL.

The circumferential length of at least vacuum zone Z1 can be between approximately 200 mm and approximately 2500 mm, and is preferably between approximately 800 mm and approximately 1800 mm, and an even more preferably between approximately 1200 mm and approximately 1600 mm. The solids leaving vacuum roll 318 in web 312 will vary between approximately 25% and approximately 55% depending on the vacuum pressures and the tension on permeable belt 334 and the pressure from the pressing device RP as well as the length of vacuum zone Z1 and also Z2, and the dwell time of web 312 in vacuum zones Z1 and Z2. The dwell time of web 312 in vacuum zones Z1 and Z2 is sufficient to result in this solids range between approximately 25% and approximately 55%.

The arrangements shown in FIGS. 20 and 21 have the following advantages: if a very high bulky web is not required, this option can be used to increase dryness and therefore production to a desired value, by adjusting carefully the mechanical pressure load. Due to the softer second fabric 220 or 320, the web 212 or 312 is also pressed at least partly between the prominent points (valleys) of the three-dimensional structure 214 or 314. The additional pressure field can be arranged preferably before (no re-wetting), after, or between the suction area. The upper permeable belt 234 or 334 is designed to resist a high tension of more than approximately 30 KN/m, and preferably approximately 60 KN/m, or higher e.g., approximately 80 KN/M. By utilizing this tension, a pressure is produced of greater than approximately 0.5 bars, and preferably approximately 1 bar, or higher, may be e.g., approximately 1.5 bar. The pressure "p" depends on the tension "S" and the radius "R" of the suction roll 218 or 318 according to the well known equation, p=S/R. The upper belt 234 or 334 can also be stainless steel and/or a metal band. The permeable upper belt 234 or 334 can be made of a reinforced plastic or synthetic material. It can also be a spiral linked fabric. Preferably, the belt 234 or 334 can be driven to avoid shear forces between the first fabric 214 or 314, the second fabric 220 or 320 and the web 212 or 312. The suction roll 218 or 318 can also be driven. Both of these can also be driven independently.

The permeable belt 234 or 334 can be supported by a perforated shoe PS for providing the pressure load.

The air flow can be caused by a non-mechanical pressure field as follows: with an underpressure in a suction box of the suction roll (118, 218 or 318) or with a flat suction box SB (see FIG. 17). It can also utilize an overpressure above the first surface of the pressure producing element 134, PS, RP, 234 and 334 by, e.g., by hood 124 (although not shown, a hood can also be provided in the arrangements shown in FIGS. 17, 20 and 21), supplied with air, e.g., hot air of between approximately 50 degrees C. and approximately 180 degrees C., and preferably between approximately 120 degrees C. and approximately 150 degrees C., or also preferably steam. Such a higher temperature is especially important and preferred if the pulp temperature out of the headbox is less than about 35 degrees C. This is the case for manufacturing processes without or with less stock refining. Of course, all or some of the above-noted features can be combined to form advantageous press arrangements, i.e. both the underpressure and the overpressure arrangements/devices can be utilized together.

The pressure in the hood can be less than approximately 0.2 bar, preferably less than approximately 0.1, most preferably less than approximately 0.05 bar. The supplied air flow to the hood can be less or preferable equal to the flow rate sucked out of the suction roll 118, 218, or 318 by vacuum pumps.

The suction roll 118, 218 and 318 can be wrapped partly by the package of fabrics 114, 214, or 314 and 120, 220, or 320, and the pressure producing element, e.g., the belt 134, 234, or 334, whereby the second fabric e.g., 220, has the biggest wrapping arc "a2" and leaves the larger arc zone Z1 lastly (see FIG. 20). The web 212 together with the first fabric 214 leaves secondly (before the end of the first arc zone Z2), and the pressure producing element PS/234 leaves firstly. The arc of the pressure producing element PS/234 is greater than an arc of the suction zone arc "a2". This is important, because at low dryness, the mechanical dewatering together with dewatering by air flow is more efficient than dewatering by airflow only. The smaller suction arc "a1" should be big enough to ensure a sufficient dwell time for the air flow to reach a maximum dryness. The dwell time "T" should be greater than approximately 40 ms, and preferably is greater than approximately 50 ms. For a roll diameter of approximately 1.2 mm and a machine speed of approximately 1200 m/min, the arc "a1" should be greater than approximately 76 degrees, and preferably greater than approximately 95 degrees. The formula is a1=[dwell time*speed*360/circumference of the roll].

The second fabric 120, 220, 320 can be heated e.g., by steam or process water added to the flooded nip shower to improve the dewatering behavior. With a higher temperature, it is easier to get the water through the felt 120, 220, 320. The belt 120, 220, 320 could also be heated by a heater or by the hood, e.g., 124. The TAD-fabric 114, 214, 314 can be heated especially in the case when the former of the tissue machine is a double wire former. This is because, if it is a crescent former, the TAD fabric 114, 214, 314 will wrap the forming roll and will therefore be heated by the stock which is injected by the headbox.

There are a number of advantages of the process using any of the herein disclosed devices such as. In the prior art TAD process, ten vacuum pumps are needed to dry the web to approximately 25% dryness. On the other hand, with the advanced dewatering systems of the invention, only six vacuum pumps are needed to dry the web to approximately 35%. Also, with the prior art TAD process, the web should preferably be dried up to a high dryness level of between about 60% and about 75%, otherwise a poor moisture cross profile would be created. This way a lot of energy is wasted and the Yankee and hood capacity is only used marginally. The systems of the instant invention make it possible to dry the web in a first step up to a certain dryness level of between approximately 30% to approximately 40%, with a good moisture cross profile. In a second stage, the dryness can be increased to an end dryness of more than approximately 90% using a conventional Yankee/hood (impingement) dryer combined the inventive system. One way to produce this dryness level, can include more efficient impingement drying via the hood on the Yankee.

Figure 22A:
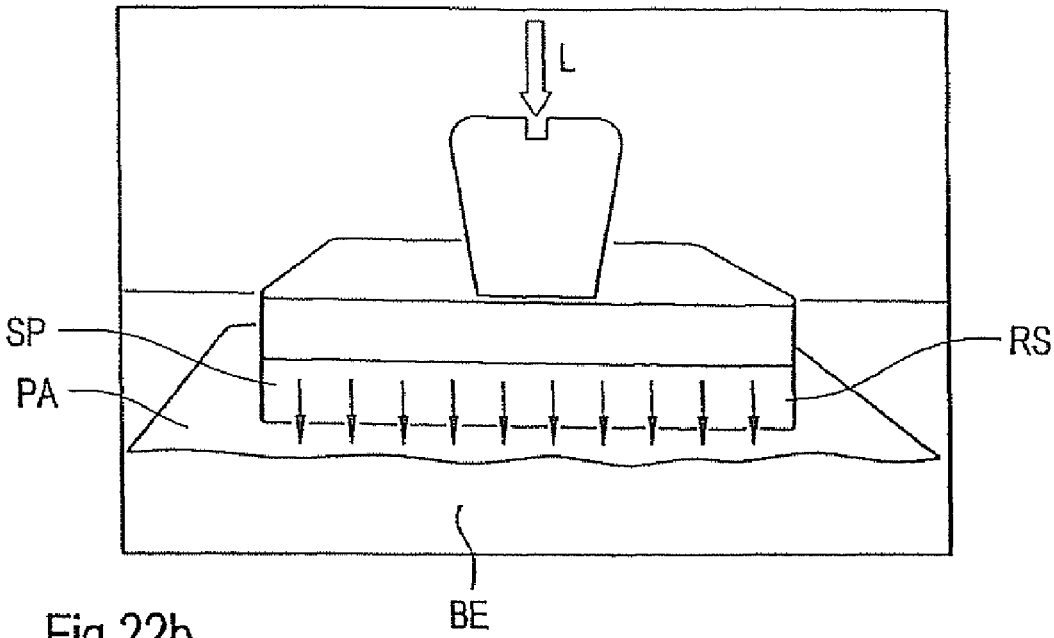
FIGS. 22*a-b* illustrate one way in which the contact area can be measured.
Figure 22B:
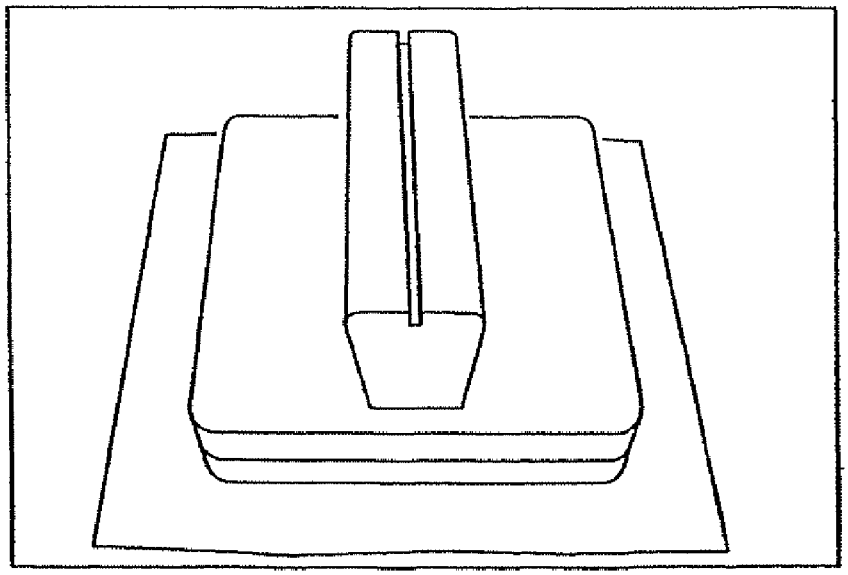

As can be seen in FIGS. 22*a* and 22*b*, the contact area of the belt BE can be measured by placing the belt upon a flat and hard surface. A low and/or thin amount of die is placed on the belt surface using a brush or a rag. A piece of paper PA is placed over the dyed area. A rubber stamp RS having a 70 shore A hardness is placed onto the paper. A 90 kg load L is placed onto the stamp. The load creates a specific pressure SP of about 90 KPa.

The entire disclosure of U.S. patent application Ser. No. 10/768,485 filed on Jan. 30, 2004 is hereby expressly incorporated by reference in its entirety. Moreover, the instant application also expressly incorporates by reference the entire disclosures of U.S. patent application Ser. No. 11/276,789 filed on Mar. 14, 2006 entitled HIGH TENSION PERMEABLE BELT FOR AN ATMOS SYSTEM AND PRESS SECTION OF PAPER MACHINE USING THE PERMEABLE BELT in the name of Ademar LIPPI ALVES FERNANDES et al., U.S. patent application Ser. No. 10/972,408 filed on Oct. 26, 2004 entitled ADVANCED DEWATERING SYSTEM in the name of Jeffrey HERMAN et al. and U.S. patent application Ser. No. 10/972,431 filed on Oct. 26, 2004 entitled PRESS SECTION AND PERMEABLE BELT IN A PAPER MACHINE in the name of Jeffrey HERMAN et al.

Figure 24:
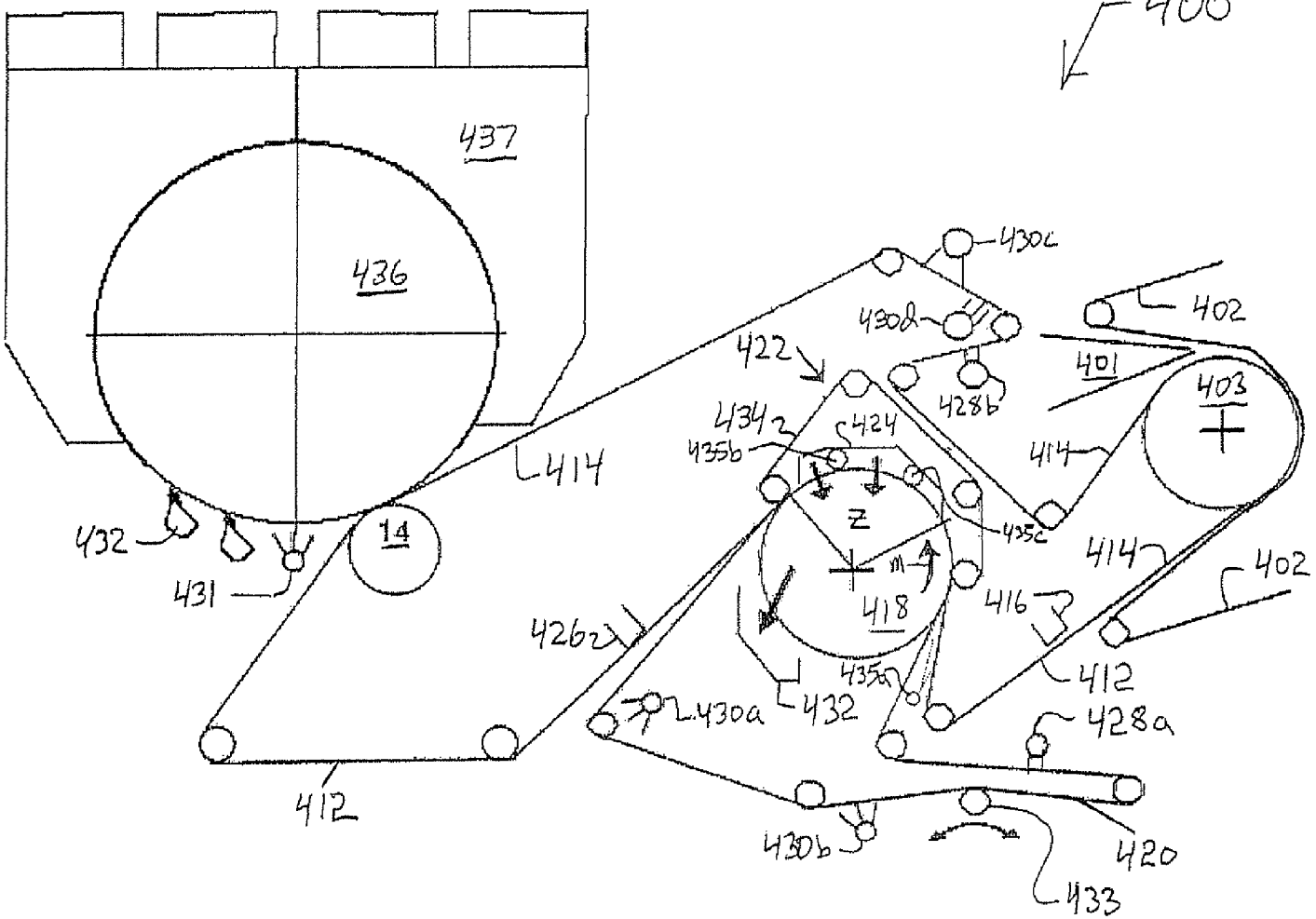
FIG. 24 is a cross-sectional schematic diagram of a machine or system which utilizes a belt press having a high tension permeable belt according to the present invention.
Figure 25:
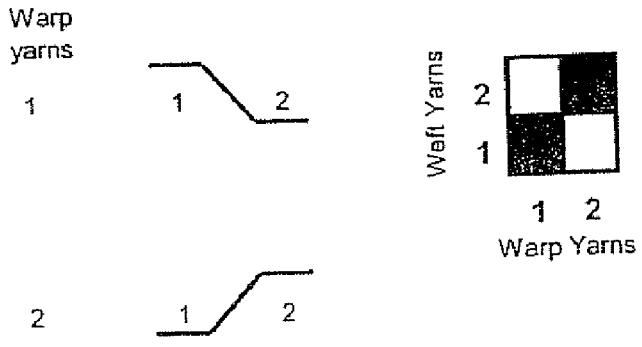
FIG. 25 shows one non-limiting embodiment of a weave pattern which can be used for the forming fabric according to the invention.
Figure 26:
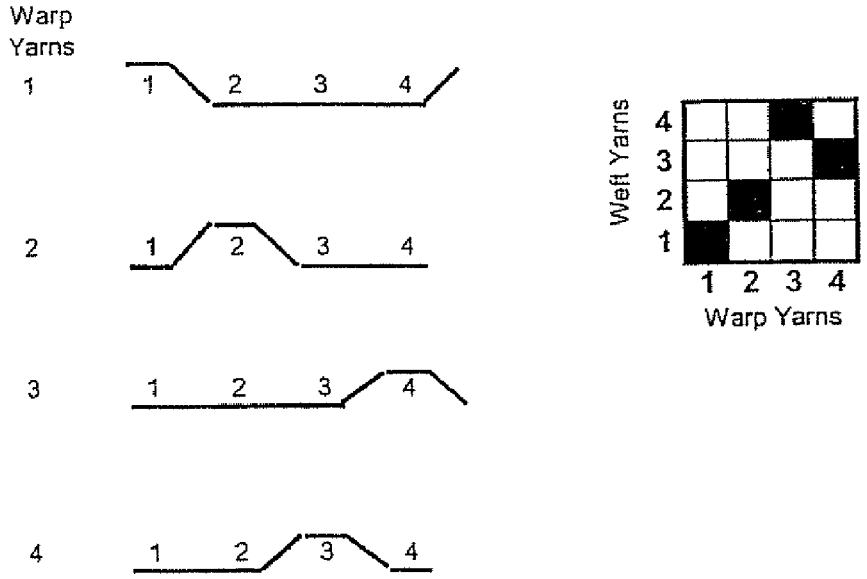
FIG. 26 shows another non-limiting embodiment of a weave pattern which can be used for the forming fabric according to the invention.
Figure 27:
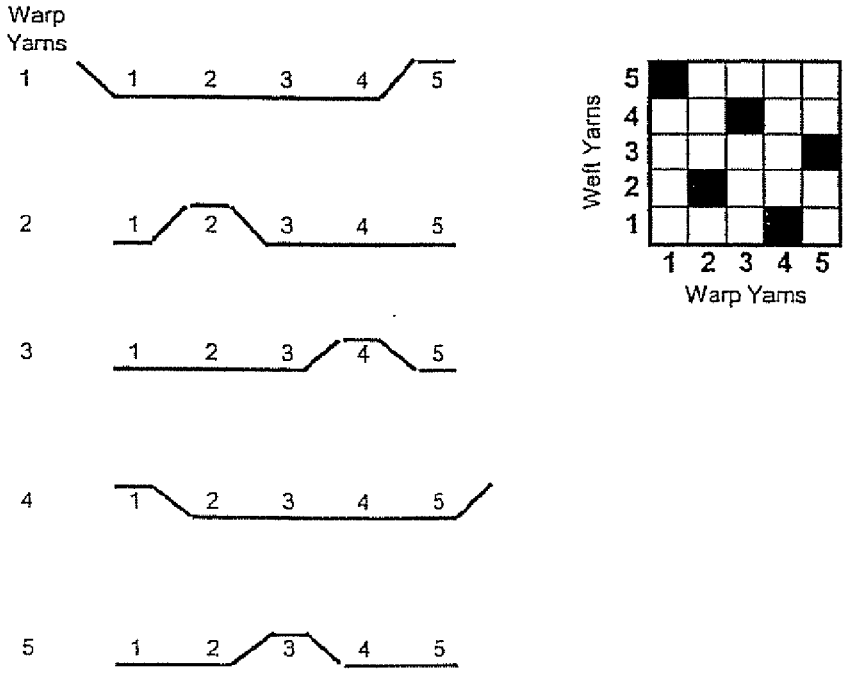
FIG. 27 shows still another non-limiting embodiment of a weave pattern which can be used for the forming fabric according to the invention.
Figure 28:
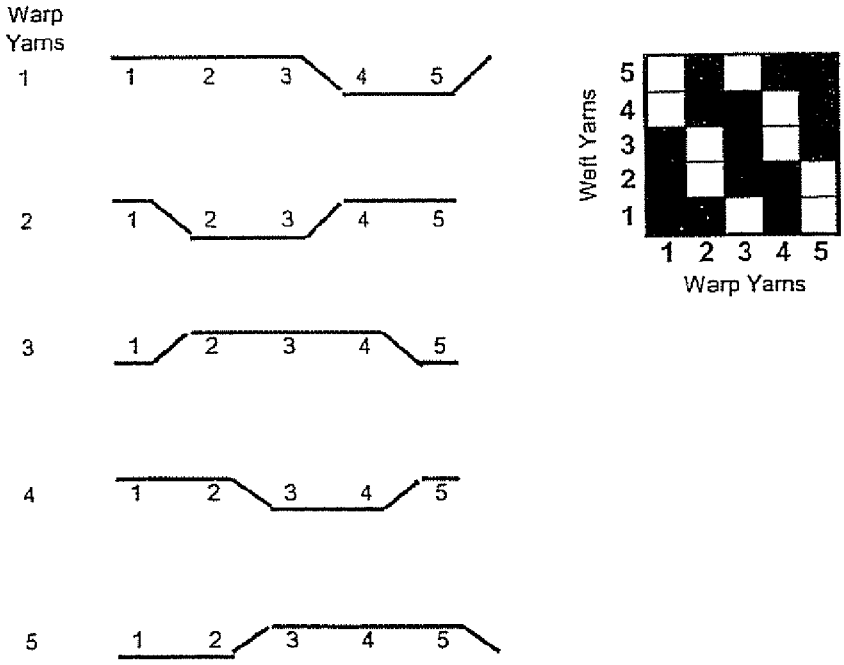
FIG. 28 shows another non-limiting embodiment of a weave pattern which can be used for the forming fabric according to the invention.
Figure 29:
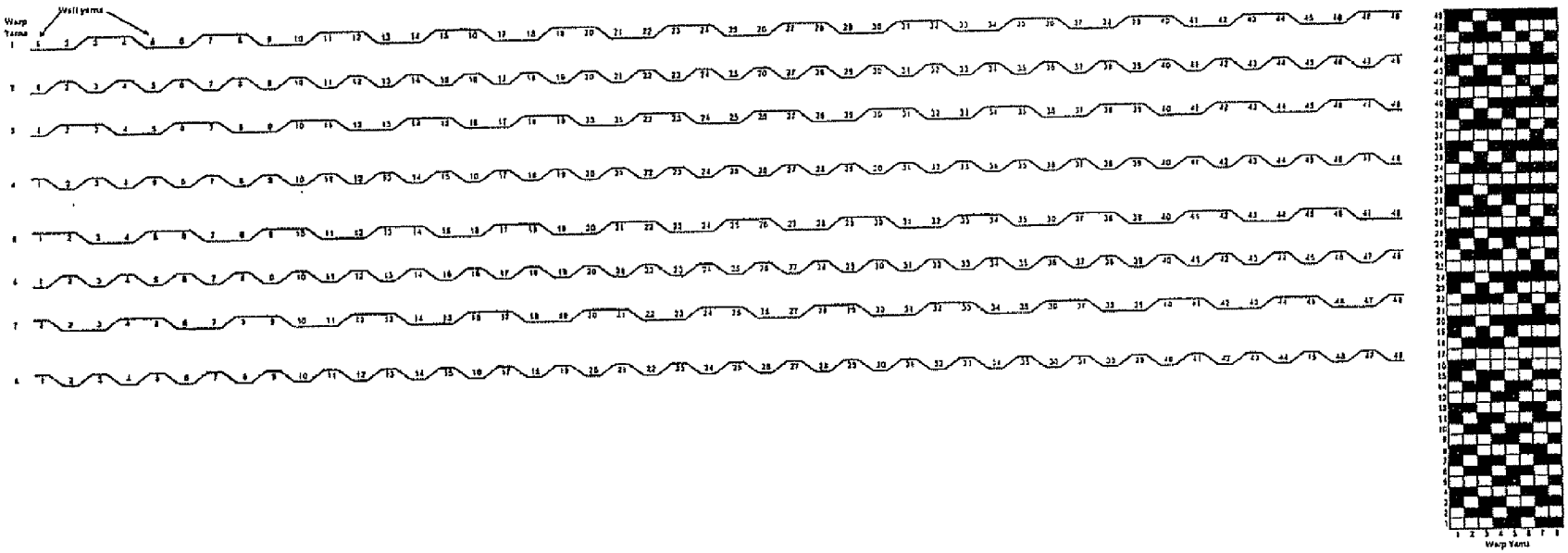
FIG. 29 shows another non-limiting embodiment of a weave pattern which can be used for the forming fabric according to the invention.
Figure 30:
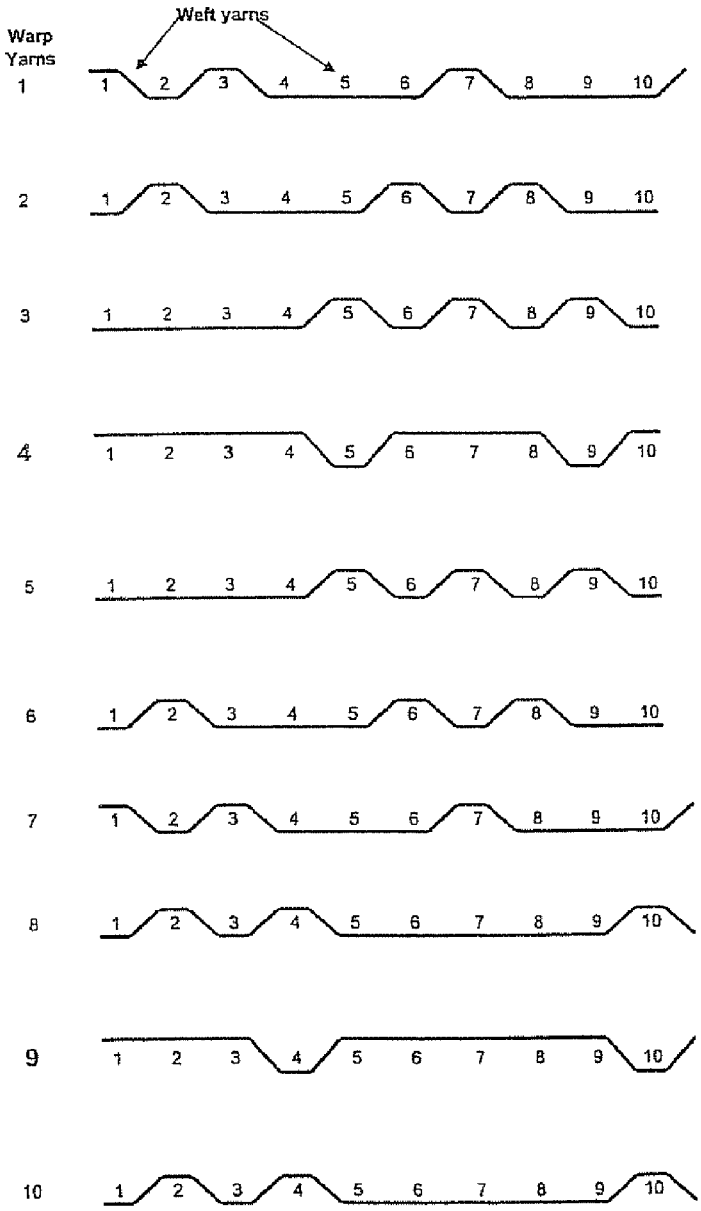
FIG. 30 shows another non-limiting embodiment of a weave pattern which can be used for the forming fabric according to the invention.
Figure 30:
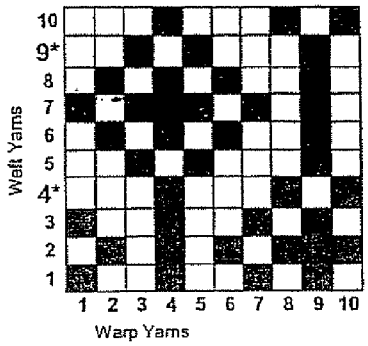

Referring now to the embodiment shown in FIG. 24, there is shown a system 400 for processing a fibrous web 412, e.g., the ATMOS system of the Assignee. System 400 utilizes a headbox 401 which feeds a suspension into a forming region formed by a forming roll 403, an inner moulding fabric 414 and an outer forming fabric 402. The formed web 412 exits the forming region on fabric 414 and the outer forming fabric 402 is separated from the web 412. The system 400 also utilizes a suction box 416, a vacuum roll 418, a dewatering fabric 420, a belt press assembly 422, a hood 424 (which may be a hot air hood), a pick up suction box 426, a Uhle box 428, one or more shower units 430*a*-430*d*, 431 and 435*a*-435*c*, one or more savealls 432, a Yankee roll 436, and a hood 437. As is evident from FIG. 24, the suction device 416 provides auctioning to one side of the web 412, while the suction roll 418 provides auctioning to an opposite side of the web 12.

Fibrous web 412 is moved by forming fabric 414 in a machine direction M past the suction box 416. At the vacuum box 416, sufficient moisture is removed from web 412 to achieve a solids level of between approximately 15% and approximately 25% on a typical or nominal 20 gram per square meter (gsm) web running. The vacuum at the box 416 provides between approximately −0.2 to approximately −0.8 bar vacuum, with a preferred operating level of between approximately −0.4 to approximately −0.6 bar. As fibrous web 412 proceeds along the machine direction M, it comes into contact with a dewatering fabric 420. The dewatering fabric 420 can be an endless circulating belt which is guided by a plurality of guide rolls and is also guided around the suction roll 418. The tension of the fabric 420 can be adjusted by adjusting guide roll 433. The dewatering belt 420 can be a dewatering fabric of the type shown and described in FIG. 13 or 14 herein. The dewatering fabric 420 can also preferably be a felt. The web 412 then proceeds toward vacuum roll 418 between the fabric 414 and the dewatering fabric 420. The vacuum roll 418 rotates along the machine direction M and is operated at a vacuum level of between approximately −0.2 to approximately −0.8 bar with a preferred operating level of at least approximately −0.4 bar, and most preferably approximately −0.6 bar. By way of non-limiting example, the thickness of the vacuum roll shell of roll 418 may be in the range of between approximately 25 mm and approximately 75 mm. The mean airflow through the web 412 in the area of the suction zone Z can be approximately 150 $m^3$/min per meter of machine width. The forming fabric 414, web 412 and dewatering fabric 420 are guided through a belt press 422 formed by the vacuum roll 418 and a permeable belt 434. As is shown in FIG. 24, the permeable belt 434 is a single endlessly circulating belt which is guided by a plurality of guide rolls and which presses against the vacuum roll 418 so as to form the belt press 422.

The upper forming fabric 414, which is described in detail below, is an endless fabric which transports the web 412 to and from the belt press system 422 and from the forming roll 403 to the final drying arrangement which includes a Yankee cylinder 436, a hood 437, one or more coating showers 431 as well as one or more creping devices 432. The web 412 lies in the three-dimensional structure of the upper fabric 414, and therefore it is not flat but has also a three-dimensional structure, which produces a high bulky web. The lower fabric 420 is also permeable. The design of the lower fabric 420 is made to be capable of storing water. The lower fabric 420 also has a smooth surface. The lower fabric 420 is preferably a felt with a batt layer. The diameter of the batt fibers of the lower fabric 420 are equal to or less than approximately 11 dtex, and can preferably be equal to or lower than approximately 4.2 dtex, or more preferably be equal to or less than approximately 3.3 dtex. The batt fibers can also be a blend of fibers. The lower fabric 420 can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the baft layer of the lower fabric 420 and/or of the lower fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the lower fabric 420 should be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the lower fabric 420 should be considered. This is important in order to dewater the web efficiently to a high dryness level. A hard surface would not press the web 412 between the prominent points of the structured surface of the upper fabric. On the other hand, the felt should not be pressed too deep into the three-dimensional structure to avoid loosing bulk and therefore quality, e.g., water holding capacity.

The permeable belt 434 can be a single or multi-layer woven fabric which can withstand the high running tensions, high pressures, heat, moisture concentrations and achieve a high level of water removal required by the papermaking process. The fabric 434 should preferably have a high width stability, be able to operate at high running tensions, e.g., between approximately 20 kN/m and approximately 100 kN/m, and preferably greater than or equal to approximately 20 kN/m and less than or equal to approximately 60 kN/m. The fabric 434 should preferably also have a suitable high permeability, and can be made of hydrolysis and/or temperature resistant material. As is apparent from FIG. 24, the permeable high tension belt 434 forms part of a "sandwich" structure which includes a structured forming or molding belt 414 and the dewatering belt 420, These belts 414 and 420, with the web 412 located there between, are subjected to pressure in the pressing device 422 which includes the high tension belt 434 arranged over the rotating roll 418. In other embodiments, the belt press is used in a device of the type shown in FIG. 17, i.e., a static extended dewatering nip.

Referring back to FIG. 24, the nip formed by the belt press 422 and roll 418 can have an angle of wrap of between approximately 30 degrees and 180 degrees, and preferably between approximately 50 degrees and approximately 140 degrees. By way of non-limiting example, the nip length can be between approximately 800 mm and approximately 2500 mm, and can preferably be between approximately 1200 mm and approximately 1500 mm. Also, by way of non-limiting example, the diameter of the suction roll 418 can be between approximately 1000 mm and approximately 2500 mm or greater, and can preferably be between approximately 1400 mm and approximately 1700 mm.

To enable suitable dewatering, the single or multilayered fabric 434 should preferably have a permeability value of between approximately 100 cfm and approximately 1200 cfm, and is most preferably between approximately 300 cfm and approximately 800 cfm. The nip can also have an angle of wrap that is preferably between 50 degrees and 130 degrees. The single or multi-layered fabric or permeable belt 434 can also be an already formed (i.e., a prejoined or seamed belt) an endless woven belt. Alternatively, the belt 434 can be a woven belt that has its ends joined together via a pin-seam or can be instead be seamed on the machine. The single or multi-layered fabric or permeable belt 434 can also preferably have a paper surface contact area of between approximately 5% and approximately 70% when not under pressure or tension. The contact surface of the belt should not be altered by subjecting the belt to sanding or grinding. By way of non-limiting example, the belt 434 should have a high open area of between approximately 10% and approximately 85%. The single or multi-layered fabric or permeable belt 434 can also be a woven belt having a paper surface warp count of between approximately 5 yarns/cm and approximately 60 yarns/cm, and is preferably between approximately 8 yarns/cm and approximately 20 yarns/cm, and is most preferably between approximately 10 yarns/cm and approximately 15 yarns/cm. Furthermore, the woven belt 434 can have a paper surface weft count of between approximately 5 yarns/cm and approximately 60 yarns/cm, and is preferably between approximately 8 yarns/cm and approximately 20 yarns/cm, and is most preferably between approximately 11 yarns/cm and approximately 14 yarns/cm.

Due to the high moisture and heat which can be generated in the ATMOS papermaking process, the woven single or multi-layered fabric or permeable belt 434 can be made of one or more hydrolysis and/or heat resistant materials. The one or more hydrolysis resistant materials can preferably be a PET monofilament and can ideally have an intrinsic viscosity value normally associated with dryer and TAD fabrics, i.e., in the range of between 0.72 IV and 1.0 IV. These materials can also have a suitable "stabilization package" including carboxyl end group equivalents etc. When considering hydrolysis resistance, one should consider the carboxyl end group equivalents, as the acid groups catalyze hydrolysis, and residual DEG or di-ethylene glycol as this too can increase the rate of hydrolysis. These factors separate the resin which should be used from the typical PET bottle resin. For hydrolysis, it has been found that the carboxyl equivalent should be as low as possible to begin with and should be less than 12. For DEG level, less than 0.75% should preferably be used. Even that this low level of carboxyl end groups, it is essential that an end capping agent be added. A carbodiimide should be used during extrusion to ensure that at the end of the process there are no free carboxyl groups. There are several classes of chemical that can be used to cap the end groups, such as epoxies, ortho-esters and isocyanates, but, in practice, monomeric and combinations of monomeric with polymeric carbodiimindes are the best and most used. Preferably, all end groups are capped by an end capping agent that may be selected from the above-noted classes such that there are no free carboxyl end groups.

PPS can be used for the heat resistant materials. Other single polymer materials such as PEN, PBT, PEEK and PA can also be used to improve properties such as stability, cleanliness and life. Both single polymer yarns as well as copolymer yarns can be used.

The material used for the high tension belt 434 may not necessarily be made from monofilament, and can also be a multifilament, including the core and sheath. Other materials such as non-plastic materials can also be used, e.g., metal materials.

The permeable belt need not be made of a single material and can also be made of two, three or more different materials, i.e., the belt can be a composite belt The permeable belt 434 can also be formed with an external layer, coating, and/or treatment which is applied by deposition and/or which is a polymeric material that can be cross linked during processing. Preferably, the coating enhances the fabric stability, contamination resistance, drainage, wearability, improved heat and/or hydrolysis resistance. It is also preferable if the coating reduces fabric surface tension to aide sheet release or to reduce drive loads. The treatment or coating can be applied to impart and/or improve one or more of these properties.

Ideally, the permeable belt 434 has good to excellent permeability and surface contact area. The materials and weave of the belt are less important than such considerations.

In such an ATMOS system, the dewatering fabric must work very efficiently to achieve the necessary dryness, i.e., approximately 32% or better for towel and approximately 35% or better for tissue, prior to the sheet reaching the Yankee.

The details of the forming fabric 414 will now be discussed. The assignee company of the instant patent application developed a technology which would allow existing machines to be rebuilt and also developed new machines that made tissue with increased paper quality and to the highest standards. Such machines, however, require different forming fabrics and one main aim of the invention is to provide such fabrics For example, such fabrics should has a very high resilience and/or softness in order to react properly in an environment where it experiences pressure provided by the tension belt. Such forming fabrics should also have very good pressure transfer characteristics in order to achieve uniform dewatering, especially when the pressure is provided by the tension belt of an ATMOS system. The fabric should also have high temperature stability so that it performs well in the temperature environments which result from the use of hot air blow boxes. A certain range of air permeability is also needed for the fabric so that when hot air is blown from above the forming fabric and vacuum pressure is applied to the vacuum side of the fabric (or the paper package which includes the same), the mixture of water and air (i.e., hot air) will pass through the fabric and/or package containing the fabric.

The forming fabric 414 can be a single or multi-layered woven fabric which can withstand the high pressures, heat, moisture concentrations, and which can achieve a high level of water removal and also mold or emboss the paper web required by the Voith ATMOS paper making process. The forming fabric 414 should also have a width stability, a suitable high permeability. The forming fabric 414 should also preferably utilize hydrolysis and/or temperature resistant materials.

The forming fabric 414 is utilized as part of a sandwich structure which includes at least two other belts and/or fabrics. These additional belts include a high tension belt 434 and a dewatering belt 420. The sandwich structure is subjected to pressure and tension over an extended nip formed by a rotating roll, e.g., 418, or static support surface (see e.g., FIGS. 15-17). The extended nip can have an angle of wrap of between approximately 30 degrees and approximately 180 degrees, and is preferably between approximately 50 degrees and approximately 130 degrees. The nip length can be between approximately 800 mm and approximately 2500 mm, and is preferably between approximately 1200 mm and approximately 1500 mm. The nip can be formed by a rotating suction roll, e.g., 418, having a diameter that is between approximately 1000 mm and approximately 2500 mm, and is preferably between approximately 1400 mm and approximately 1700 mm.

The forming fabric 414 imparts a topographical pattern into the paper sheet or web 412. To accomplish this, high pressures are imparted to the forming or molding fabric 414 via a high tension belt 434. The topography of the sheet pattern can be manipulated by varying the specifications of the molding belt 414, i.e., by regulating parameters such as, yarn diameter, yarn shape, yarn density, and yarn type. Different topographical patterns can be imparted in the sheet 412 by different surface weaves. Similarly, the intensity of the sheet pattern can be varied by altering the pressure imparted by the high tension belt 434 and by varying the specification of the molding belt 414. Other factors which can influence the nature and intensity of the typographical pattern of the sheet 412 include air temperature, air speed, air pressure, belt dwell time in the extended nip, and nip length.

The following are non-limiting characteristics and/or properties of the forming fabric 414: to enable suitable dewatering, the single or multi-layered fabric 414 should have a permeability value of between approximately 100 cfm and approximately 1200 cfm, and is preferably between approximately 200 cfm and approximately 900 cfm; the forming fabric 414 which is part of a sandwich structure with two other belts, e.g., a high tension belt 434 and a dewatering belt 420, is subjected to pressure and tension over a rotating or static support surface and at an angle of wrap of between approximately 30 degrees and approximately 180 degrees and preferably between approximately 50 degrees and approximately 130 degrees; the forming fabric 414 should have a paper surface contact area of between approximately 0.5% and approximately 90% when not under pressure or tension; the forming fabric 414 should have an open area of between approximately 1.0% and approximately 90%. The forming fabric 414 can also preferably have a paper surface contact area of between approximately 5% and approximately 70% when not under pressure or tension and an open area of between approximately 10% and approximately 90%.

The forming fabric 414 is preferably a woven fabric that can be installed on an ATMOS machine (see FIG. 24) as a pre-joined and/or seamed continuous and/or endless belt. Alternatively, the forming fabric 414 can be joined in the ATMOS machine using e.g., a pin-seam arrangement or can otherwise be seamed on the machine. In order to resist the high moisture and heat generated by the ATMOS papermaking process, the woven single or multi-layered belt 414 may utilize either hydrolysis and/or heat resistant materials. Hydrolysis resistant materials should preferably include a PET monofilament having an intrinsic viscosity value normally associated with dryer and TAD fabrics in the range of between 0.72 IV and approximately 1.0 IV and also have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. The DEG level should be less than approximately 0.75%. Even at this low level of carboxyl end groups it is essential that an end capping agent be added, and should utilize a carbodiimide during extrusion to ensure that at the end of the process there are no free carboxyl groups. There are several classes of chemical than can be used to cap the end groups such as epoxies, ortho-esters, and isocyanates, but in practice monomeric and combinations of monomeric with polymeric carbodiimindes are the best and most used. Preferably, all end groups are capped by an end capping agent that may be selected from one or more conventional materials such that there are no free carboxyl end groups.

Heat resistant materials such as PPS can be utilized in the forming fabric 414. Other materials such as PEN, PBT, PEEK and PA can also be used to improve properties of the forming fabric 414 such as stability, cleanliness and life. Both single polymer yarns and copolymer yarns can be used. The material for the belt 414 need not necessarily be made from monofilament and can be a multi-filament, core and sheath, and could also be a non-plastic material, i.e., a metallic material. Similarly, the fabric 414 may not necessarily be made of a single material and can be made of two, three or more different materials. The use of shaped yarns, i.e., non-circular yarns, can also be utilized to enhance or control the topography or properties of the paper sheet. Shaped yarns can also be utilized to improve or control fabric characteristics or properties such as stability, caliper, surface contact area, surface planarity, permeability and wearability.

The forming fabric 414 can also be treated and/or coated with an additional polymeric material that is applied by e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduces drive loads. The treatment/coating can be applied to impart/improve one or several of these properties of the fabric 414. As indicated previously, the topographical pattern in the paper web 412 can be changed and manipulated by use of different single and multi-layer weaves. Further enhancement of the pattern can be further attained by adjustments to the specific fabric weave by changes to the yarn diameter, yarn counts, yarn types, yarn shapes, permeability, caliper and the addition of a treatment or coating etc. Non-limiting examples of weave patterns and fabric specifications for the fabric 414 are shown in FIGS. 25-35. Finally, one or more surfaces of the forming fabric or molding belt can be subjected to sanding and/or abrading in order to enhance surface characteristics.

It is noted that the foregoing examples have been provided merely for the purpose of explanation and are in no way to be construed as limiting of the present invention. While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

What is claimed:

1. A belt press for a paper machine, the belt press comprising:

a forming fabric comprising a paper web facing side and being guided over a support surface;

said forming fabric comprising a permeability value of between approximately 100 cfm and approximately 1200 cfm, a paper surface contact area of between approximately 0.5% and approximately 90% when not under pressure and tension, and an open area of between approximately 1.0% and approximately 90%.

2. The belt press of claim 1, wherein the belt press is arranged on an ATMOS system.

3. The belt press of claim 1, wherein the belt press is arranged on a TAD machine.

4. The belt press of claim 1, wherein at least one surface of the forming fabric comprises at least one of an abraded surface and a sanded surface.

5. The belt press of claim 1, wherein the paper web facing side of the forming fabric comprises at least one of an abraded surface and a sanded surface.

6. The belt press of claim 1, wherein the permeability value is between approximately 200 cfm and approximately 900 cfm.

7. The belt press of claim 1, wherein the forming fabric comprises a single material.

8. The belt press of claim 1, wherein the forming fabric comprises a monofilament material.

9. The belt press of claim 1, wherein the forming fabric comprises a multifilament material.

10. The belt press of claim 1, wherein the forming fabric comprises two or more different materials.

11. The belt press of claim 1, wherein the forming fabric comprises three different materials.

12. The belt press of claim 1, wherein the forming fabric comprises a polymeric material.

13. The belt press of claim 1, wherein the forming fabric is treated with a polymeric material.

14. The belt press of claim 1, wherein the forming fabric comprises a polymeric material that is applied by deposition.

15. The belt press of claim 1, wherein the forming fabric comprises at least one of shaped yams, generally circular shaped yams, and non-circular shaped yams.

16. The belt press of claim 1, wherein the forming fabric is resistant to at least one of hydrolysis and temperatures which exceed 100 degrees C.

17. The belt press of claim 1, wherein the support surface is static.

18. The belt press of claim 1, wherein the support surface is arranged on a roll.

19. The belt press of claim 18, wherein the roll is a vacuum roll having a diameter of between approximately 1000 mm and approximately 2500 mm.

20. The belt press of claim 19, wherein the vacuum roll has a diameter of between approximately 1400 mm and approximately 1700 mm.

21. The belt press of claim 1, wherein the belt press forms an extended nip with the support surface.

22. The belt press of claim 21, wherein the extended nip has an angle of wrap of between approximately 30 degrees and approximately 180 degrees.

23. The belt press of claim 22, wherein the angle of wrap is between approximately 50 degrees and approximately 130 degrees.

24. The belt press of claim 21, wherein the extended nip has a nip length of between approximately 800 mm and approximately 2500 mm.

25. The belt press of claim 24, wherein the nip length is between approximately 1200 mm and approximately 1500 mm.

26. The belt press of claim 1, wherein the forming fabric is an endless belt that is either pre-seamed, has its ends joined on a machine which utilizes the belt press, has its ends pin-seamed, has its ends joined via a single pintle wire, or has its ends joined via multiple pintle wires.

27. The belt press of claim 1, wherein the forming fabric is structured and arranged to impart a topographical pattern to a web.

28. The belt press of claim 27, wherein the web comprises at least one of a tissue web, a hygiene web, and a towel web.

29. A method of subjecting a fibrous web to pressing in a paper machine using the belt press of claim 1, the method comprising:

applying pressure to the forming fabric and the fibrous web in a belt press.

30. A fibrous material drying arrangement comprising:

an endlessly circulating forming fabric guided over a roll;

said forming fabric comprising a permeability value of between approximately 100 cfm and approximately 1200 cfm, a paper surface contact area of between approximately 0.5% and approximately 90% when not under pressure and tension, and an open area of between approximately 1.0% and approximately 90%.

31. A method of subjecting a fibrous web to pressing in a paper machine using the arrangement of claim 30, the method comprising:

applying pressure to the forming fabric and the fibrous web in a belt press.

32. A method of subjecting a fibrous web to pressing in a paper machine using a forming fabric for an ATMOS system or a TAD machine, wherein the forming fabric comprises a permeability value of between approximately 100 cfm and approximately 1200 cfm, a paper surface contact area of between approximately 0.5% and approximately 90% when not under pressure and tension, and an open area of between approximately 1.0% and approximately 90%, the method comprising:

passing the forming fabric through a belt press; and applying pressure to the forming fabric and the fibrous web using the belt press.

* * * * *